US006647750B2

(12) United States Patent
Kaneko et al.

(10) Patent No.: US 6,647,750 B2
(45) Date of Patent: Nov. 18, 2003

(54) BUCKLE

(75) Inventors: Hitoshi Kaneko, Toyama-ken (JP); Ryuichi Murasaki, Toyama-ken (JP); Yoshinobu Takahashi, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/904,876

(22) Filed: Jul. 16, 2001

(65) Prior Publication Data

US 2002/0014096 A1 Feb. 7, 2002

(30) Foreign Application Priority Data

Jul. 31, 2000 (JP) ..... 2000-231701
Jul. 31, 2000 (JP) ..... 2000-231702
Dec. 22, 2000 (JP) ..... 2000-391330

(51) Int. Cl.[7] ..... E05B 73/00; E05B 65/00; A44B 11/26

(52) U.S. Cl. ..... 70/58; 70/57.1; 24/614; 24/606; 24/625

(58) Field of Search ..... 70/57.1, 58, 18; 24/704.1, 614, 150, 615, 616, 625, 171, 196, 198, 200, 265 BC, 606, 633, 635, 639, 640

(56) References Cited

U.S. PATENT DOCUMENTS 3,157,929 A * 11/1964 Warner et al. ..... 24/196
3,169,291 A * 2/1965 Stacherl ..... 24/196
3,389,440 A * 6/1968 Jantzen ..... 24/196
3,592,028 A * 7/1971 La Monica ..... 24/191
4,282,634 A * 8/1981 Krauss ..... 24/313
4,398,324 A 8/1983 Bakker et al.
4,551,889 A * 11/1985 Narayan et al. ..... 24/171
4,745,664 A * 5/1988 Damvig ..... 24/704.1
4,864,700 A * 9/1989 Kasai ..... 24/578.15
4,865,366 A * 9/1989 Kretchman ..... 24/453
4,866,819 A * 9/1989 Kasai ..... 24/614
4,912,950 A * 4/1990 Crowle ..... 24/167
4,930,324 A * 6/1990 Meier ..... 70/18
4,953,269 A * 9/1990 Ragsdale ..... 24/625
5,048,161 A * 9/1991 Watanabe et al. ..... 24/669
5,245,731 A * 9/1993 Funathu ..... 24/200
5,293,668 A * 3/1994 Tibiletti ..... 206/338
5,307,542 A * 5/1994 Murai ..... 24/169
5,309,610 A * 5/1994 le Gal ..... 24/615
5,551,131 A * 9/1996 Anscher ..... 24/606
5,590,444 A * 1/1997 Krauss ..... 24/625
5,855,057 A * 1/1999 Anscher ..... 24/614
5,873,505 A * 2/1999 Sovitski ..... 224/576
6,000,109 A * 12/1999 Anscher ..... 24/614
6,170,133 B1 * 1/2001 Uehara ..... 24/614
6,189,348 B1 * 2/2001 Huang ..... 24/615
6,247,210 B1 * 6/2001 Hamilton ..... 24/198

FOREIGN PATENT DOCUMENTS

| | | |
|---|---|---|
| AU | 583 121 | 12/1986 |
| EP | 0 535 606 | 4/1993 |
| GB | 2 127 090 | 4/1984 |
| JP | 2530126 | 3/1987 |

* cited by examiner

*Primary Examiner*—Anthony Knight
*Assistant Examiner*—Michael J. Kyle
(74) *Attorney, Agent, or Firm*—Finnegan, Henderson, Farabow, Garrett & Dunner, L.L.P.

(57) ABSTRACT

In a buckle, in which a housing of a female body and an inserting plate of a male body are engaged with each other and which is provided with a simple locking mechanism by using a key, the housing of the female body is provided with an engaging portion, while the inserting plate of the male body is provided with an engaged portion. Alternatively, the housing is provided with an engaged portion while the inserting plate is provided with an engaging portion. Therefore, the female body and the male body can be engaged with each other to be locked. When they are locked, a belt adjusting portion of the male body is concealed in the housing of the female body, so that a belt is difficult to be adjusted. Specifically, the belt can be never loosened but only adjustable in a direction of fastening. Thus, the buckle is provided with a convenient belt adjusting portion, which can not adjust a length of the belt when the female body and the male body are locked with each other.

18 Claims, 23 Drawing Sheets

BUCKLE

BACKGROUND OF THE INVENTION

1. Field of the Invention

The present invention relates to a buckle comprising a rectangular female body provided with a belt attaching portion at one end thereof and a flat male body to be inserted in the female body and provided with a belt adjusting portion at one end thereof. The present invention particularly relates to a buckle, which is capable of appropriately adjusting a fastening of the belt without being influenced by a thickness of the belt and is also capable of being provided with a simple locking mechanism. The buckle can be used for a fastening belt used for a package of a commodity by door-to-door parcel delivery or for a travelling bag or the like.

2. Description of the Related Art

An example of a conventional buckle is shown in FIG. 37, in which the attaching and fixing of one end of a belt to a male member 2' of the buckle is as follows. In the buckle, a horizontally long hole as a connection adjusting portion 31' is defined on a side wall at one end portion of the male member 2', and a bar-shaped member 34' for winding the belt thereon is supported at its axis so as to be movable back and forth in the long hole. The bar-shaped member 34', which faces a fixed bar member 36' fixed to the male member 2', pulls the belt wound around the bar-shaped member 34' toward the fixed bar member side, so that the belt is clipped by the fixed bar member 36' and the bar-shaped member 34'. Further, with the connection adjusting portion 31' being kept in this state, the male member 2' is inserted in a holding space 6' of a tubular female member 1'. Then, the belt, which is wound around the bar-shaped member 34' and disposed on the fixed bar member 36' in a superimposed manner, is concealed between the fixed bar member 36' and a top plate, i.e. a second plate 7', of the tubular female member 1' and pressed down, so that the belt is prevented from being slack. Such a buckle is disclosed in Japanese Patent Publication No. 2530126.

According to the buckle shown in FIG. 37 as mentioned above, however, the belt, which is wound around the bar-shaped member 34' of the male member 2' and is clipped between the fixed bar member 36' and the second plate 7' of the tubular female member 1', is doubly superimposed on a top surface of the fixed bar member 36' to be pressed down by the second plate 7' of the female member 1' and fixed. Therefore, this buckle is not capable of being used if the belt is thick, and if the belt is thin, the buckle is likely to be slipped out therefrom. As a result, it is difficult to accurately hold the belt without being influenced by the thickness of the belt. Further, since this buckle is not equipped with a locking mechanism, its application range is limited to that of a normal buckle.

SUMMARY OF THE INVENTION

The present invention has been made taking the foregoing problem into consideration. A main object of the invention is to provide a buckle, which is equipped with a safe and simple locking mechanism and is capable of being used with security. Specifically, the buckle, which comprises a male body and a female body, is provided with a mechanism such that, when an inserting plate of the male body is inserted in a housing of the female body so as to lock the male body and the female body, the male body and female body are not capable of being separated and released from each other unless they are unlocked with a key. Furthermore, since a portion for adjusting a length of a belt is concealed in the housing of the female body, an operation for loosening the belt can never performed in a locking state. However, the belt is capable of being fastened by pulling the belt in a direction for tightening up the belt. Therefore, the buckle has a safe and simple locking mechanism.

In addition to the above object, a further object of the invention is to provide a buckle of a male and female type in which the key for releasing the engagement can be inserted from an opposite side to that of insertion of the male body in the housing of the female body so that the male body can be easily released from the female body.

In addition to the above objects, a further object of the invention is to provide a buckle of a male and female type in which the key for releasing the engagement is inserted in a direction orthogonal to the direction of inserting of the male body into the housing of the female body so that the male body can be easily released from the female body.

In addition to the above objects, a further object of the invention is to provide a buckle of a male and female type in which an engaging portion is provided in the housing of the female body while an engaged portion is provided on the inserting plate, or an engaged portion is provided in the housing of the female body while an engaging portion is provided on the inserting plate.

In addition to the above objects, a further object of the invention is to provide a buckle of a male and female type in which a form of a belt adjusting portion to be provided to the male body is specified, thus giving an excellent function.

In addition to the above objects, a further object of the invention is to provide a buckle of a male and female type which supports the belt mounted on the belt adjusting portion in a predetermined state.

In addition to the above objects, a further object of the invention is to provide a buckle of a male and female type in which a form of the housing of the female body is specified, thus giving an excellent function.

In addition to the above objects, a further object of the invention is to provide a buckle of a male and female type in which a shape of an interior of the housing of the female body is specified, thus giving an excellent function.

In addition to the above objects, a further object of the invention is to provide a buckle of a male and female type in which a relation between the inserting plate and the key is specified, thus giving an excellent function.

In addition to the above objects, a further object of the invention is to provide a buckle of a male and female type which is provided with a specific pressing down mechanism in the housing to press down the belt adjusting portion.

In addition to the above objects, a further object of the invention is to provide a buckle of a male and female type in which a form and a function of the key are specified, thus giving an excellent function.

In addition to the above objects, a further object of the invention is to provide a mechanism that is capable of smoothly guiding the inserting plate into the housing, thus giving an excellent function.

In order to attain the above described objects, according to the present invention, there is provided a buckle including a female body and a male body, in which said female body is formed with a holding space for holding said male body in a housing; an insertion opening for insertion of said male body and a key insertion hole for locking and releasing, both of which communicate with said holding space, are respectively provided in said housing; a belt attaching portion is provided at an end of said housing opposing to said insertion opening; said male body is provided with a belt adjusting portion at a base end of an inserting portion; an engaging portion is provided on either one of said housing and said inserting portion; an engaged portion, which is elastically deformable, is provided on the other one of said housing and said inserting portion; when said inserting portion is inserted in said housing, said engaging portion and said engaged portion are engaged with each other as well as said belt adjusting portion is concealed by said housing without being exposed; and when said inserting portion is pulled out from said housing, said engaged portion is elastically deformed by insertion of a key to release said engagement of the engaging portion and said engaged portion.

Therefore, according to the present buckle, when the male body is inserted in the female body to be locked therewith, the male body is not capable of being released unless they are unlocked with the key. Further, since the belt adjusting portion is concealed in the housing of the female body, the operation for loosening the belt can not be performed. However, it is possible to perform a fastening operation of the belt. Thus, the buckle is convenient and can be used in a safe manner, especially when it is used for a package of a commodity by door-to-door parcel delivery or a fastening belt for a travelling bag or the like.

Furthermore, in addition to the above features according to the present invention, it is preferable that said key insertion hole for releasing the engagement of the engaging portion and the engaged portion is provided at the one end of said housing opposing to said insertion opening for insertion of the male body.

Alternatively, it is preferable that said key insertion hole for releasing the engagement of the engaging portion and the engaged portion is formed in a direction orthogonal to an insertion direction of said male body in said housing.

Therefore, the insertion hole of the key is capable of being appropriately arranged in the housing in accordance with a type of the locking mechanism.

Still further, in addition to the above features according to the present invention, it is preferable that said engaging portion has a hook shape and is protruded on an upper face plate of said housing of said female body, and said engaged portion is provided on a surface of said inserting portion with one end thereof being elastically protruded upward from the other one end thereof so as to be pivotally movable, so that the engaging portion and the engaged portion can be engaged with each other.

Therefore, the engaging portion provided in the housing and the engaged portion provided in the inserting portion are capable of being engaged with each other with excellent functionality.

Still further, in addition to the above features according to the present invention, it is preferable that said engaged portion is provided on a lower face plate of said housing of said female body with one end thereof being elastically protruded in an insertion direction of said male body from the other one end thereof so as to be pivotally movable, and said engaging portion has a hook shape and is protruded on a rear surface of said inserting portion, so that the engaging portion and the engaged portion can be engaged with each other.

Therefore, the engaged portion provided in the housing and the engaging portion provided on the inserting portion are capable of being engaged with each other with excellent functionality.

Still further, in addition to the above features according to the present invention, it is preferable that a base table is provided on a lower face plate of said housing of said female body, a passageway portion for said inserting portion is formed between said base table and an upper face plate of said housing; said engaged portion is provided on said base table with one end thereof being elastically protruded in an insertion direction of said male body from the other one end thereof so as to be pivotally movable; and said engaging portion has a hook shape and is protruded on a rear surface of said inserting portion.

Therefore, the engaged portion and the engaging portion are also capable of being engaged with each other with excellent functionality, although they are different types.

Still further, in addition to the above features according to the present invention, it is preferable that said belt adjusting portion of said male body comprises a pair of supporting walls, a hitching member for hitching a belt thereon and an engaging member provided with a belt engaging portion for engaging with the belt or a folding member for folding the belt, both of which are disposed between the pair of supporting walls; and the belt passes through between said engaging member or said folding member and a lower face plate of said housing when the male body is inserted into the female body.

Therefore, it is possible to prevent the belt from being capable of being loosened with a very simple mechanism, by using the engaging member or the folding member.

Still further, in addition to the above features according to the present invention, it is preferable that a belt placing member, which is capable of placing the belt thereon, is disposed on lower portions of front ends of said pair of supporting walls.

Therefore, the belt to be strained does not droop down so that the loosening operation of the belt can not be performed at all.

Still further, in addition to the above features according to the present invention, it is preferable that said housing is formed to be thicker at a side of said insertion opening and thinner at a side of the belt attaching portion; and a pair of guide projecting ridges for guiding said pair of supporting walls of said male body are provided on a rear surface of an upper face plate of said housing, extending from said insertion opening.

Therefore, the housing is good in appearance and can efficiently hold the male body therein.

Still further, in addition to the above features according to the present invention, it is preferable that at least one guide ridge for guiding an insertion of the key is provided on an inner surface of said holding space, extending from said key insertion hole.

Therefore, it is possible to efficiently restrict the flexibility of the inserting portion.

Still further, in addition to the above features according to the present invention, it is preferable that a small projection is protruded on an inner surface of said holding space; and a notch portion is provided at an end portion of said key so that said small projection is capable of being engaged with said notch portion.

Therefore, if the front end of the key is a straight line, the key is not capable of being unlocked so that any trick on the buckle can be prevented.

Still further, in addition to the above features according to the present invention, it is preferable that at least one abutting portion, against which a front end of the key is capable of abutting, is protruded on one surface of said inserting portion.

Therefore, it is possible to more easily and more accurately discharge the inserting portion.

Still further, in addition to the above features according to the present invention, it is preferable that a supporting member is disposed between side walls of said housing; a pressing portion is provided at a center of said supporting member; and said pressing portion is formed so as to press down said hitching member when said male body is inserted into said female body.

Therefore, it is possible to accurately hitch and press down the belt.

Still further, in addition to the above features according to the present invention, it is preferable that said key has a U-shaped front end; and said engaged portion is formed so as to be capable of being pressed down by inserting of said key between opposed faces of said housing and said inserting portion.

Alternatively, it is preferable that the key has a comb-shaped front end and is provided with a pressing portion for pressing down the engaged portion at a center of thereof, and said pressing portion is formed so as to be capable of being inserted in a cut-out portion formed at a center of said inserting portion.

Further alternatively, it is preferable that said key is a flat plate and is adapted to be inserted in a hole defined on a pending portion provided on the front end of said engaged portion, and said engaged portion is formed so as to be pivotally movable.

Further alternatively, it is preferable that said key has a two-forked shape, and a front end of said key is adapted to be inserted from said key insertion hole, which is formed at a side of the upper face plate of said housing, so that said engaged portion can be pressed down.

Therefore, the types of the keys can be varied, and the keys can be formed such that they can be used for various types of buckles. Further, it is possible to prevent any trick on the buckle.

Still further, in addition to the above features according to the present invention, it is preferable that guide grooves which open from said insertion opening in an insertion direction of the male body are provided in said housing, and projecting portions for sliding in said guide grooves are provided at said belt adjusting portion.

Therefore, the male body provided with the belt adjusting portion is capable of being smoothly inserted.

DESCRIPTION OF EMBODIMENTS

Embodiments of the present invention will be explained below with reference to the drawings.

Figure 1:
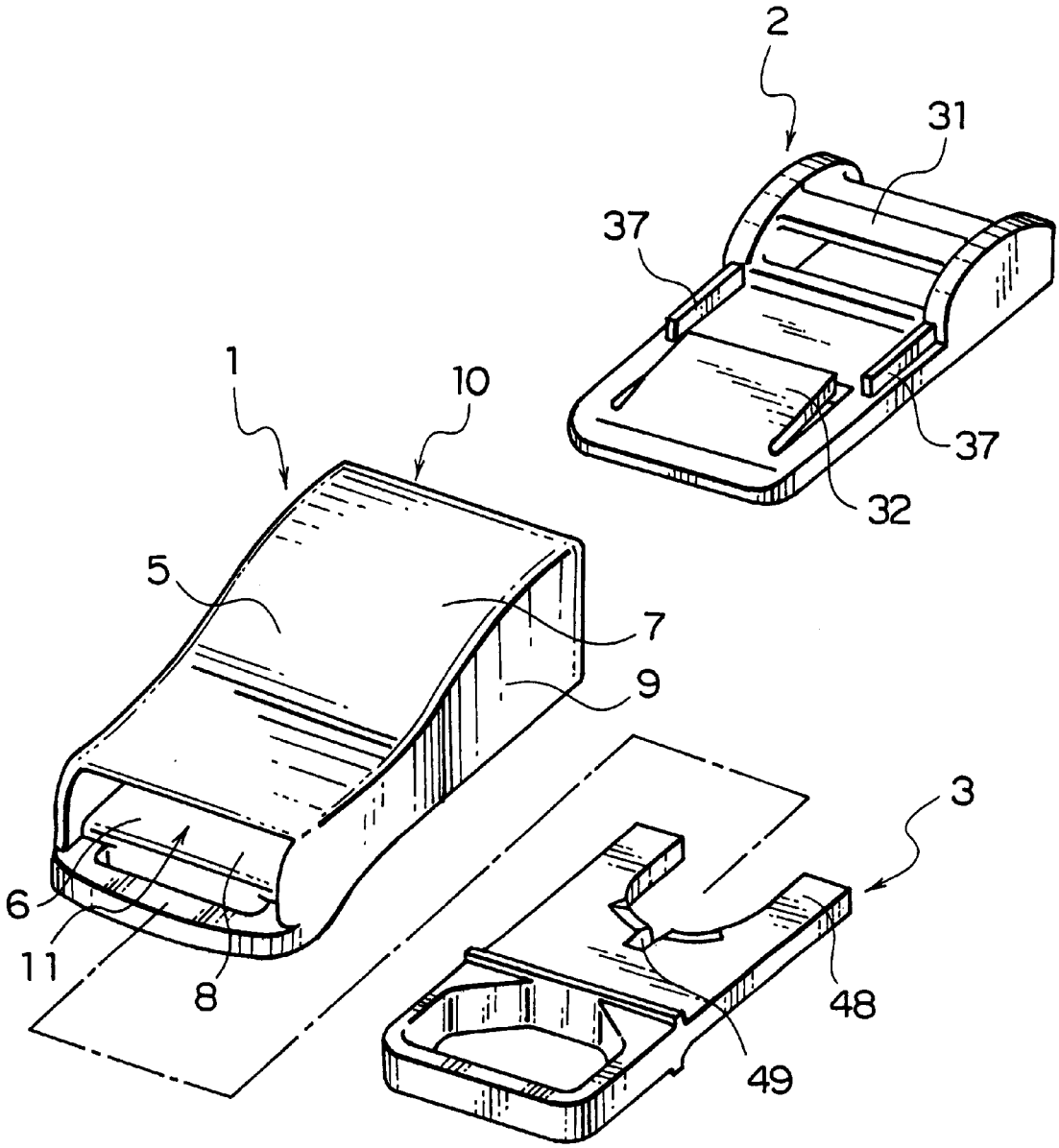
FIG. 1 is a perspective view of a buckle according to a first embodiment of the present invention.
Figure 11:
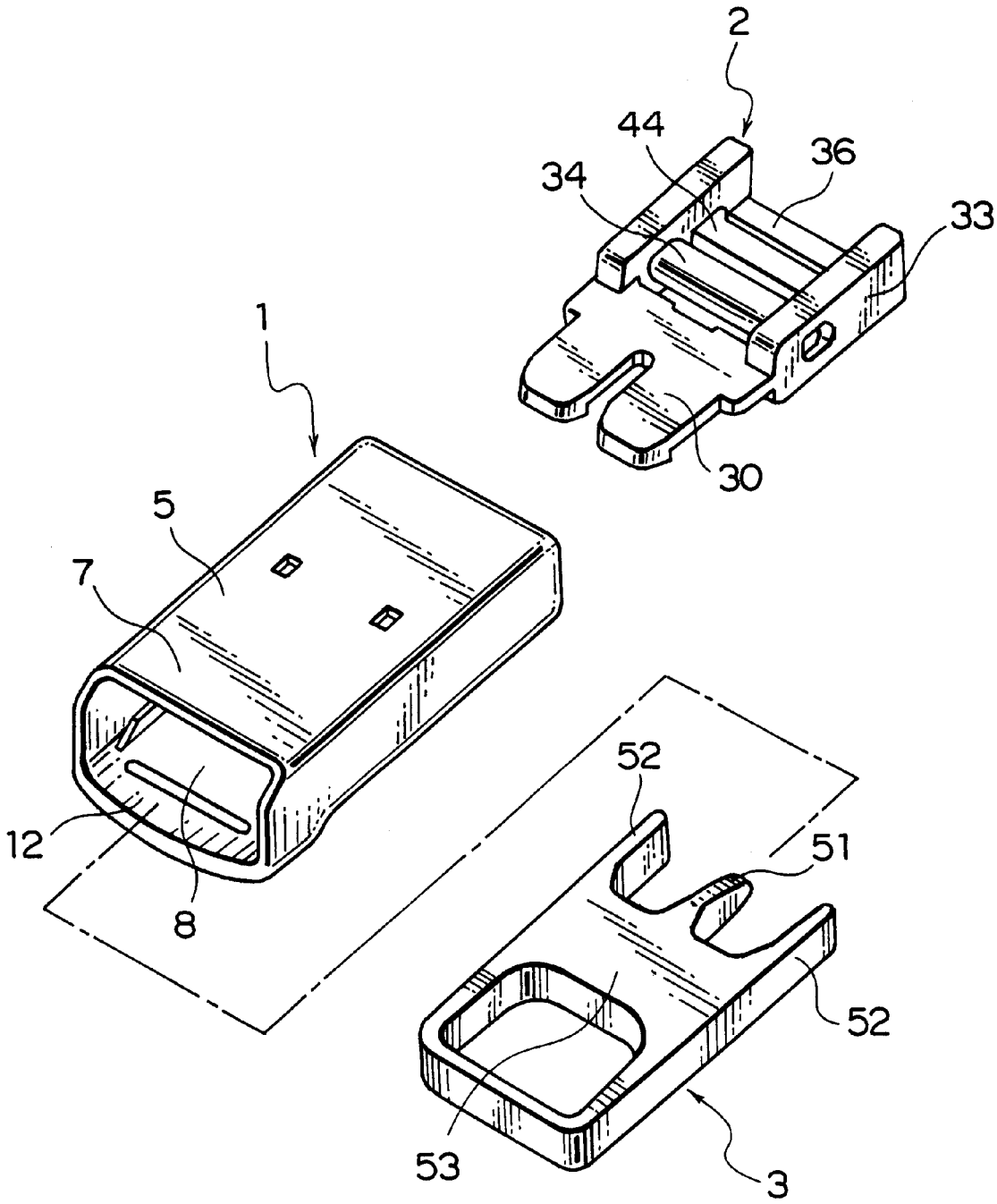
FIG. 11 is a perspective view of a buckle according to a second embodiment of the present invention.
Figure 12:
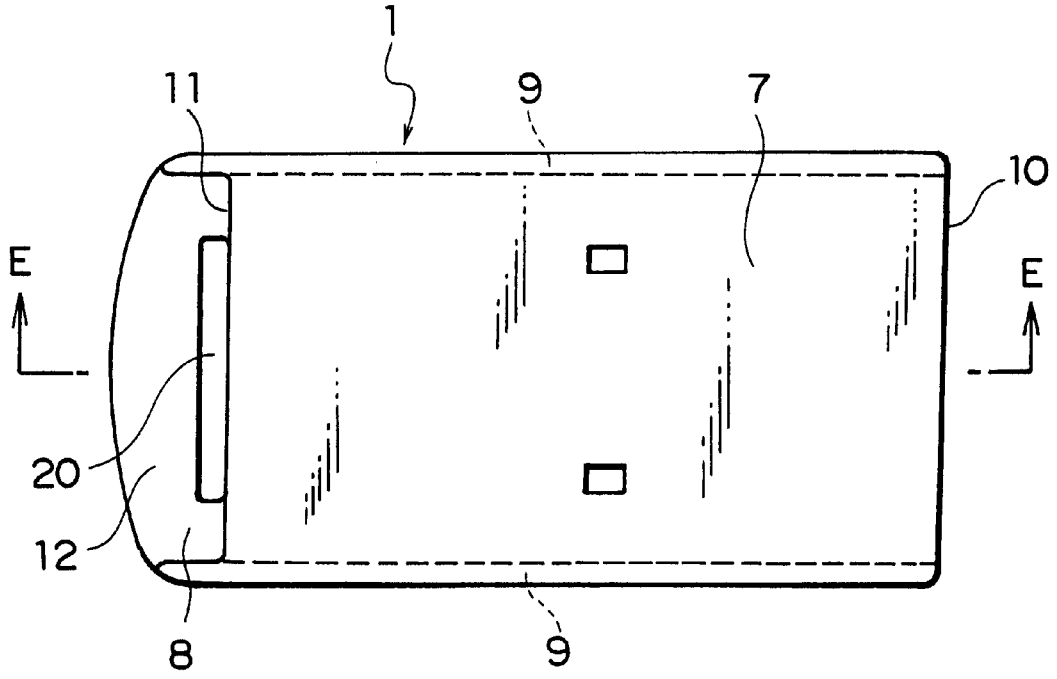
FIG. 12 is a front view of a female body of the above buckle.
Figure 23:
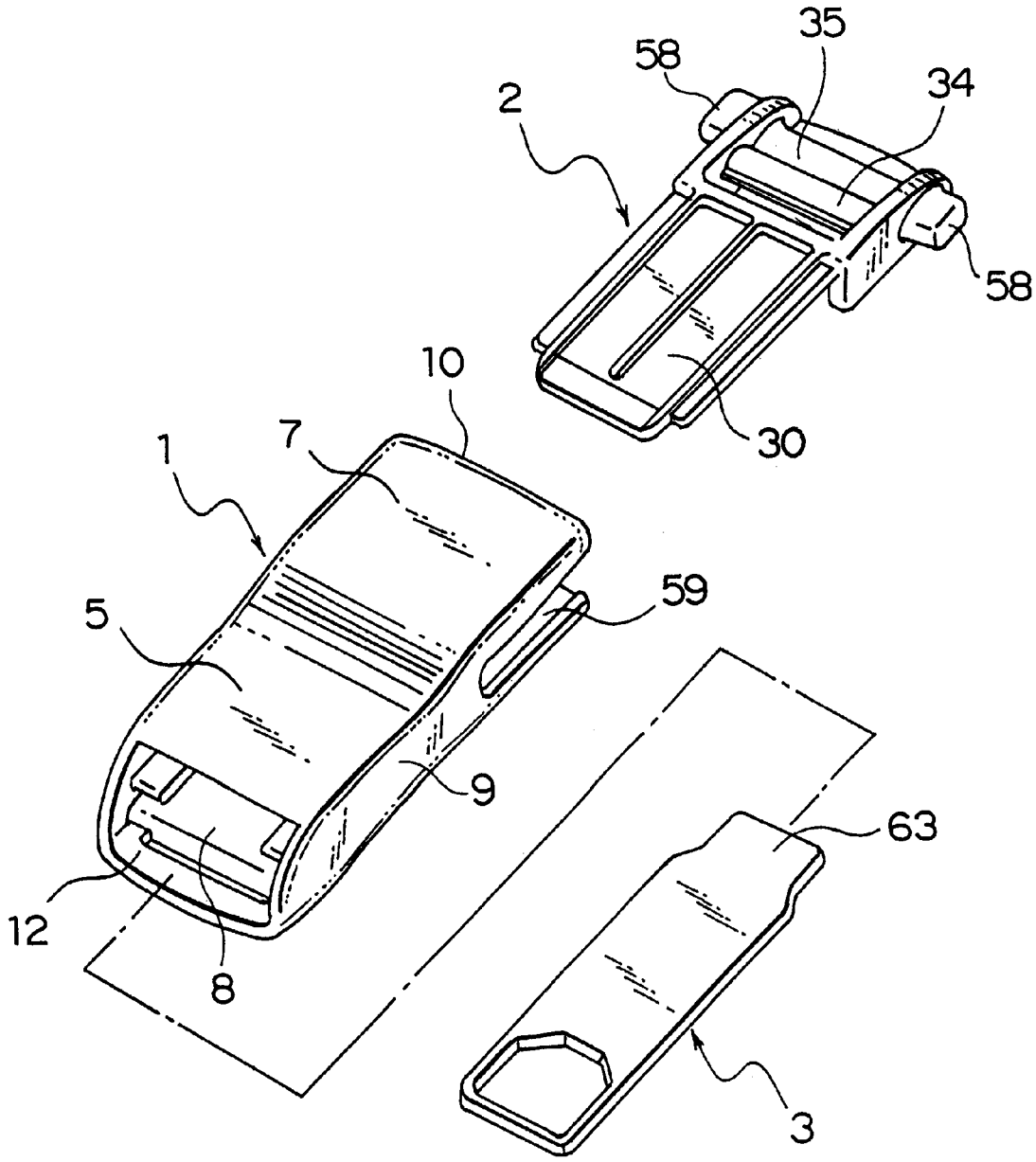
FIG. 23 is a perspective view of a buckle according to a third embodiment of the present invention.
Figure 24:
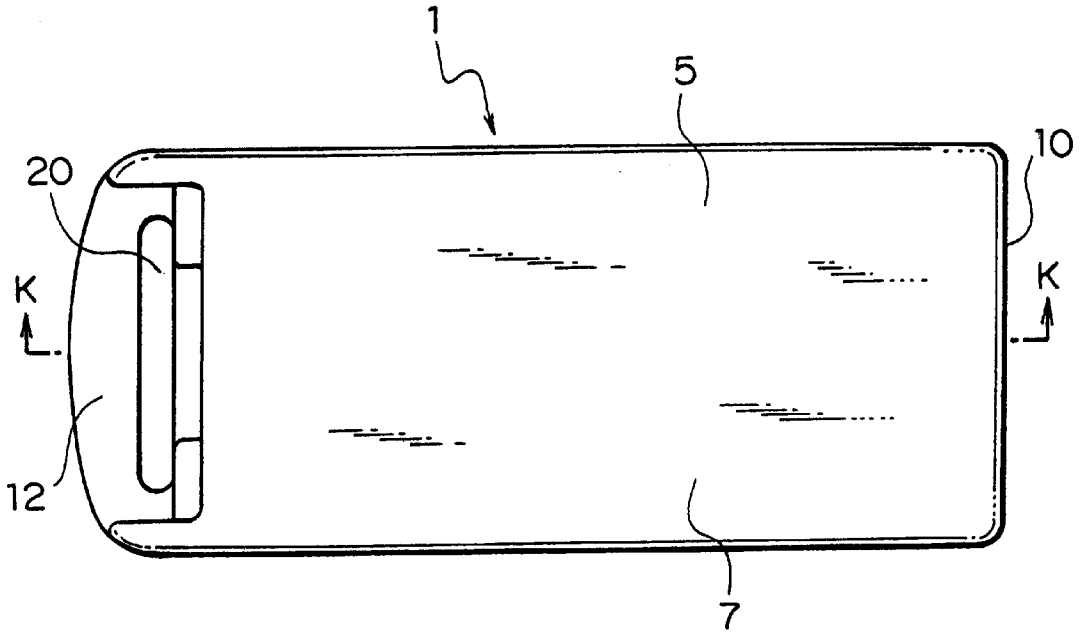
FIG. 24 is a front view of a female body in the above buckle.
Figure 32:
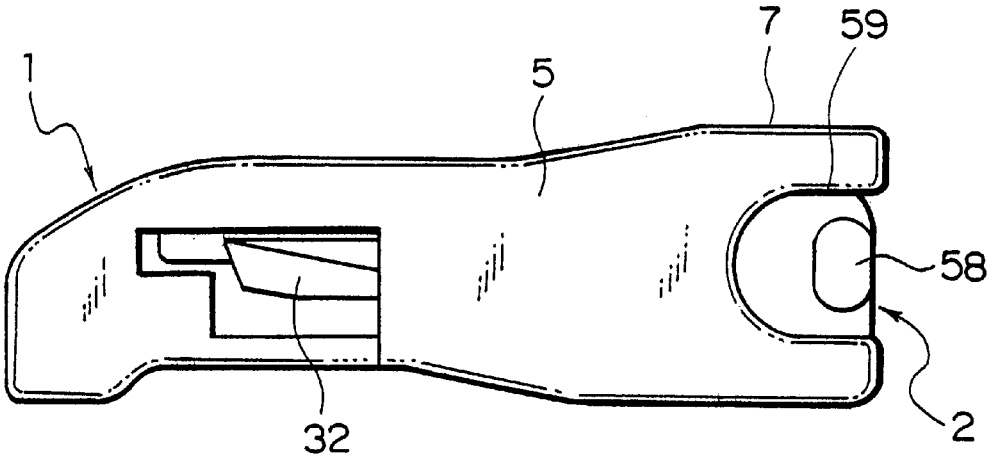
FIG. 32 is a side view of a buckle according to a fourth embodiment of the present invention.
Figure 35:
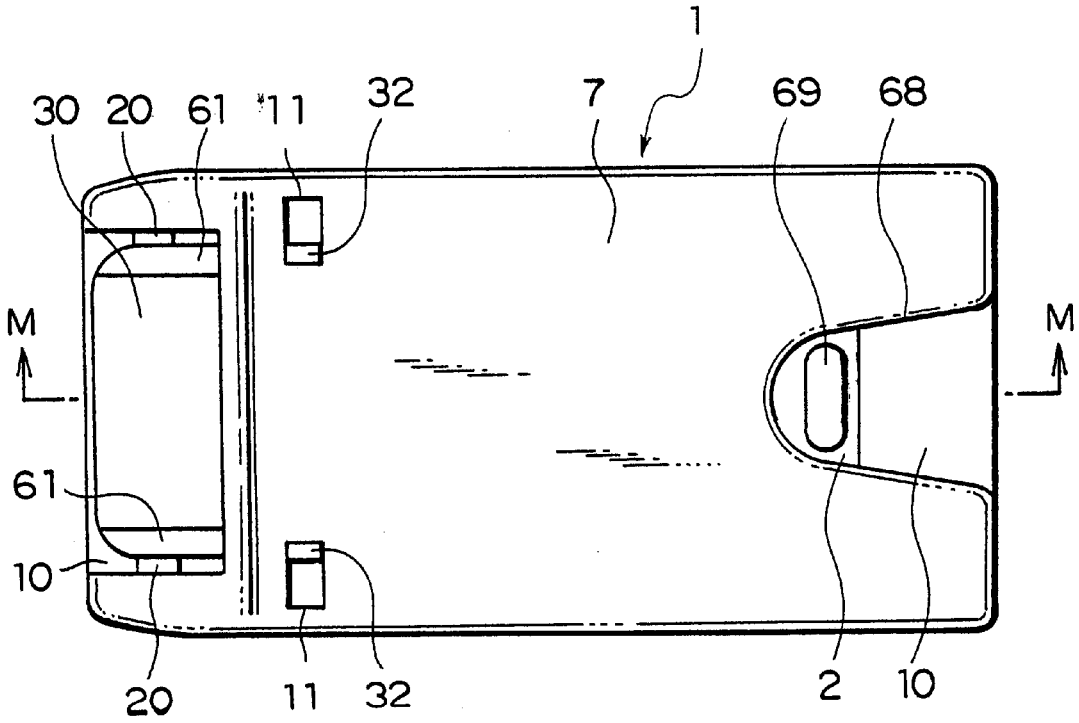
FIG. 35 is a front view showing an engaging state of a female body and a male body of a buckle according to a fifth embodiment of the present invention.

According to the present invention, each of a buckle according to a first embodiment as shown in FIG. 1, a buckle according to a second embodiment as shown in FIG. 11, a buckle according to a third embodiment as shown in FIG. 23, a buckle according to a fourth embodiment as shown in FIG. 32 and a buckle according to a fifth embodiment shown in FIG. 35 comprise three members, namely, a female body 1, which is referred to as a socket, a male body 2, which is referred to as a plug, and a key 3. The female body 1 is formed with a housing 5 having a holding space 6, which is capable of holding the male body 2. The male body 2 is equipped with an inserting plate 30, which can be inserted in the holding space 6, and a belt adjusting portion 31, on which a belt B can be attached and adjusted at one side of the buckle. The key 3 has a specific shape. The locking of the female body 1 and the male body 2 can be unlocked by insertion of the key 3 into the female body 1, so that the male body 2 can be released from the female body 1. The female body 1, the male body 2 and the key 3 are molded by injection molding means using thermoplastic resin such as polyamide, polyacetal, polypropylene or polybuthylene-terephthalate, or such resin mixed with an anti-wear reinforcement.

Figure 2:
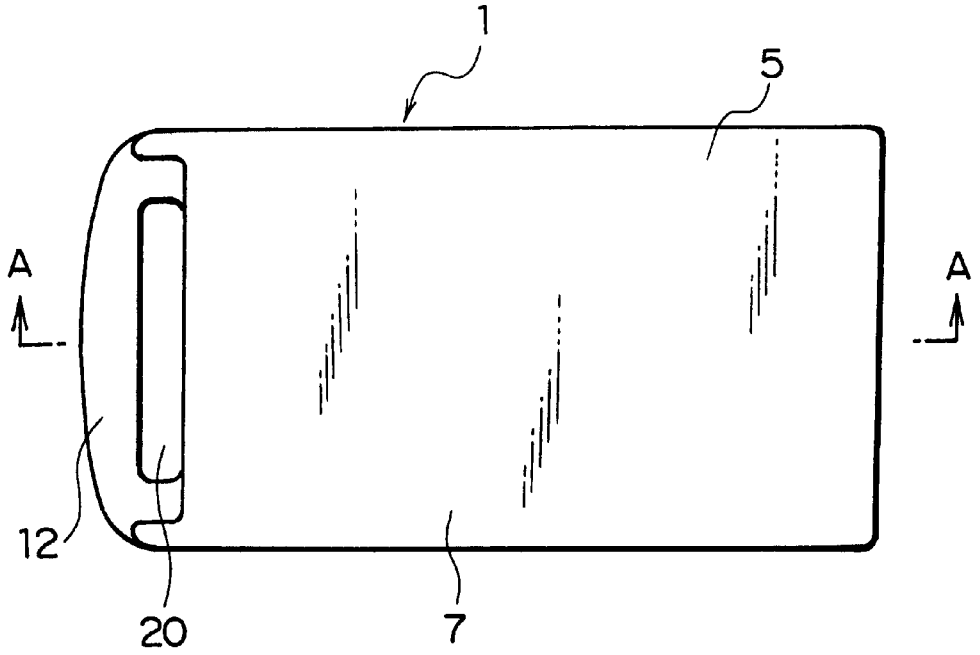
FIG. 2 is a front view of a female body of the above buckle.
Figure 3:
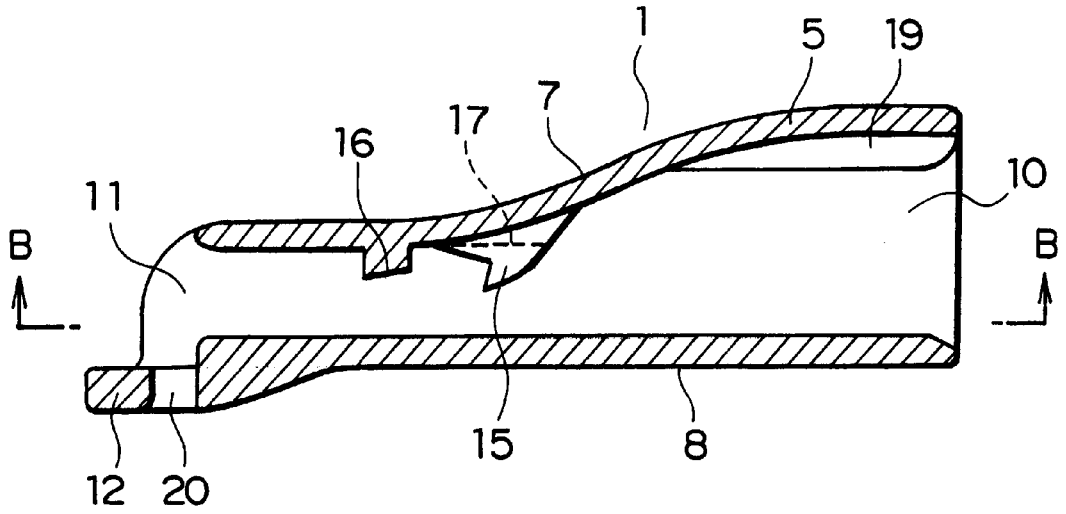
FIG. 3 is a cross sectional view taken along the line A—A of the above female body in FIG. 2.
Figure 4:
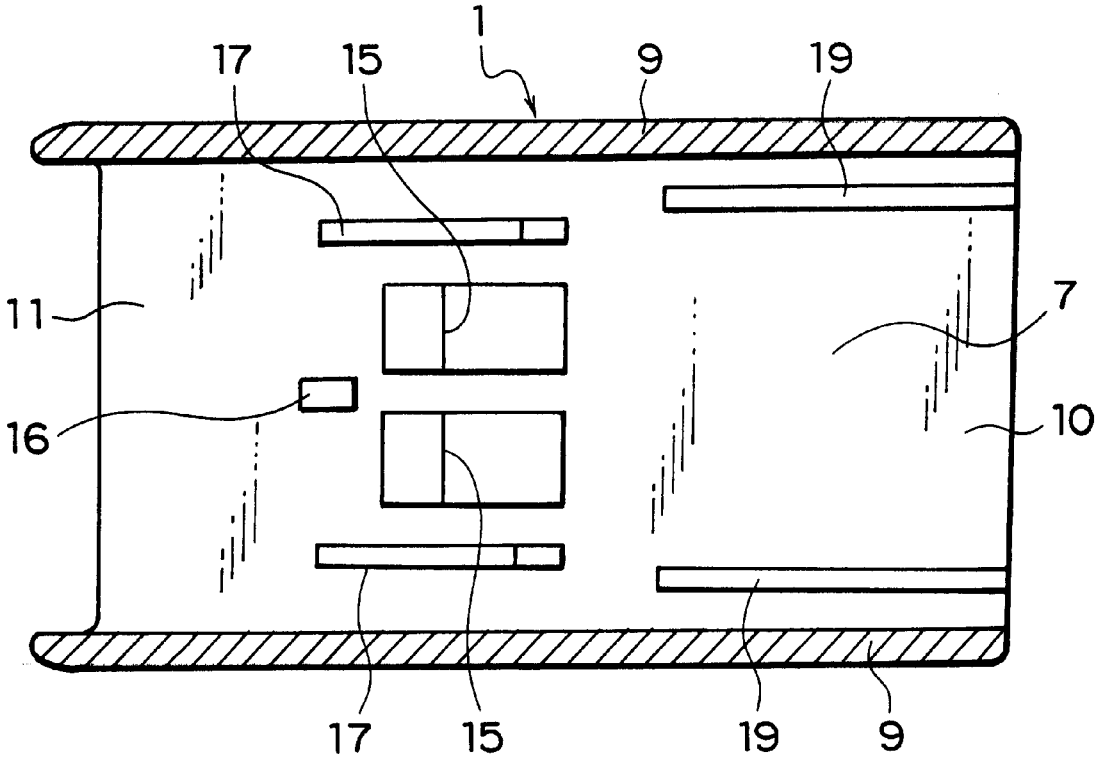
FIG. 4 is a cross sectional view taken along the line B—B of the above female body in FIG. 3.

As shown FIGS. 2 to 4, in the buckle according to the first embodiment shown in FIG. 1, the female body 1 is formed with a rectangular housing 5, which is composed of an upper face plate 7 extending in a gentle slope, a lower face plate 8 of which lower face is level, and side walls 9 extending in parallel. The holding space 6 is defined in an interior of the housing 5. Further, an insertion opening 10 which widely opens is defined at an end portion of the housing 5 which is formed to be thicker, while a key insertion hole 11 is defined at the other end portion of the housing 5 which is formed be thinner. The inserting plate 30 of the male body 2 is inserted into the insertion opening 10, so that a belt adjusting portion 31 of the male body 2 is held in the holding space 6 in such a manner that it is concealed in the upper face plate 7, the lower face plate 8 and the side walls 9 of the housing 5.

As shown in FIG. 3 and FIG. 4, two engaging portions 15, each of which has a hook shape and a tip end directed to the key insertion hole 11, are disposed laterally and protruded from a center of a sloping face at a rear surface of the upper face plate 7 of the housing 5. On a level face in front of a center between these engaging portions 15, a small projection 16 is protruded so that it can block any flat substance from intruding from the insertion hole 11. Further, guide ridges 17, each of which has a level lower surface, are provided on opposite sides of the right and left engaging portions 15. The guide ridges 17 blocks an upward flexure of the key 3, which is inserted through the key insertion hole 11. On the other hand, guide projecting ridges 19, each of which extends with a predetermined length from the insertion opening 10 and has a level lower surface, are provided on the rear surface of the upper face plate 7 at the side of the insertion opening 10. The guide projecting ridges 19 guide a pair of supporting walls 33, each of which is elevated in an arc shape, of the male body 2 inserted through the insertion opening 10, so that the male body 2 can be inserted in the holding space 6 without rattling. A through hole 20, at which the belt B can be attached, is formed at the lower face plate 8 on an opposite side to the insertion opening 10 of the housing 5, so that a belt attaching portion 12 is formed. One end of the belt B is attached to the belt attaching portion 12.

Figure 5:
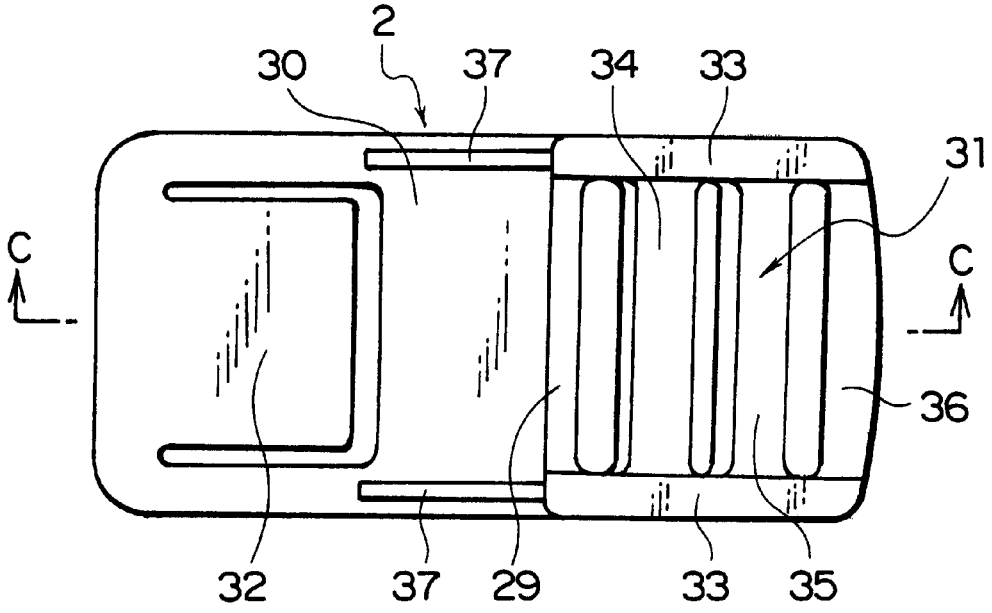
FIG. 5 is a front view of a male body of the above buckle.
Figure 6:
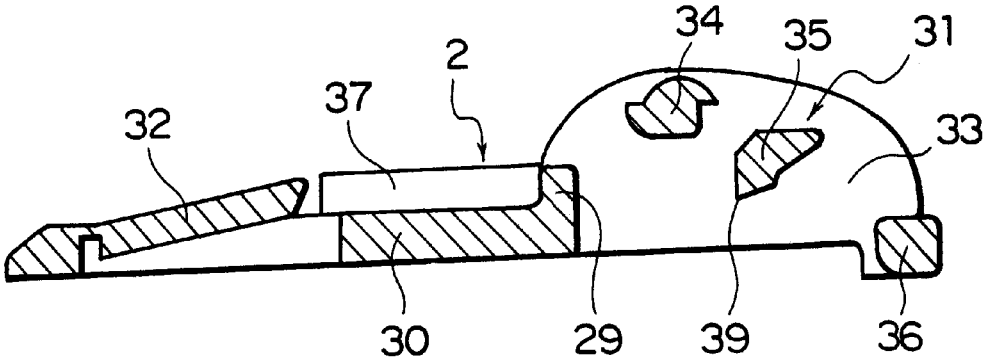
FIG. 6 is a cross sectional view taken along the line C—C of the above male body in FIG. 5.

On the other hand, as shown in FIGS. 5 and 6, the male body 2 is formed with a base member 29 laterally extending, a flat inserting plate 30 protrusively provided in front of the base member 29, and a plate-like engaged portion 32, which is formed by cutting off both sides and a back side of a substantially center portion of the flat inserting plate 30 such that a rear end of the engaged portion 32 is elastically protruded upward from a front end thereof. On opposite sides of the engaged portion 32, a pair of ridge-like abutting portions 37 are provided so as to be elevated protrude from the inserting plate 30. A front end of the key 3, which is inserted through the key inserting hold 11, abuts against the abutting portions 37. The plate-like supporting walls 33, each of which is elevated in an arc shape extending backward, are provided at opposite ends of the base member 29. A hitching member 34 for hitching the belt B thereon is disposed on upper portions of the supporting walls 33 at a side toward the base member 29. An engaging member 35, which is provided with a belt-engaging edge portion 39 capable of engaging the belt B with one end thereof, is disposed centrally so as to extend between the supporting walls 33. Further, a placing member 36, which is capable of placing the inserted belt B thereon, is disposed at lower portions of back ends of the supporting walls 33.

Figure 7:
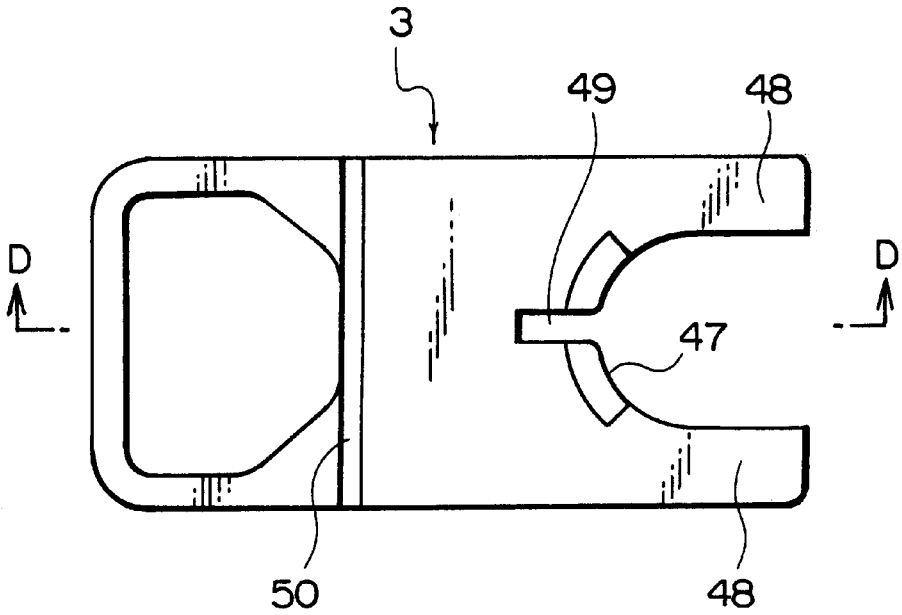
FIG. 7 is a front view of a key of the above buckle.
Figure 8:
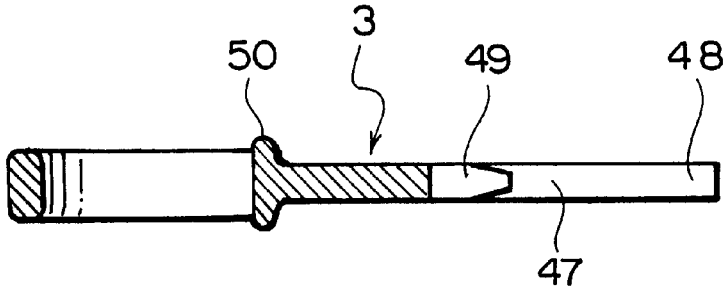
FIG. 8 is a cross sectional view taken along the line D—D of the above key in FIG. 7.

As shown in FIG. 7 and FIG. 8, the key 3 comprises a rectangular flat plate and is in a two-forked shape provided with a U-shaped recess 47 at a front end thereof. The key 3 is further formed with a pair of pressing-down leg portions 48 at opposite sides thereof, which abut against the abutting portions 37 of the inserting plate 30 of the male body 2. Furthermore, a rectangular notch portion 49 is formed at a center of the recess 47 so that it can fit on the small projection 16, which is protruded on the housing 5. Still further, one side of the key 3 opposite to the recess 47 is formed to be thicker and provided with a stepped portion 50, so that the key 3 becomes easy to be held by hand. Additionally, when the key 3 is inserted in the key insertion hole 11, the stepped portion 50 abuts against a peripheral edge of the opening of the housing 5, so that it functions to prevent further insertion of the key 3.

Figure 9:
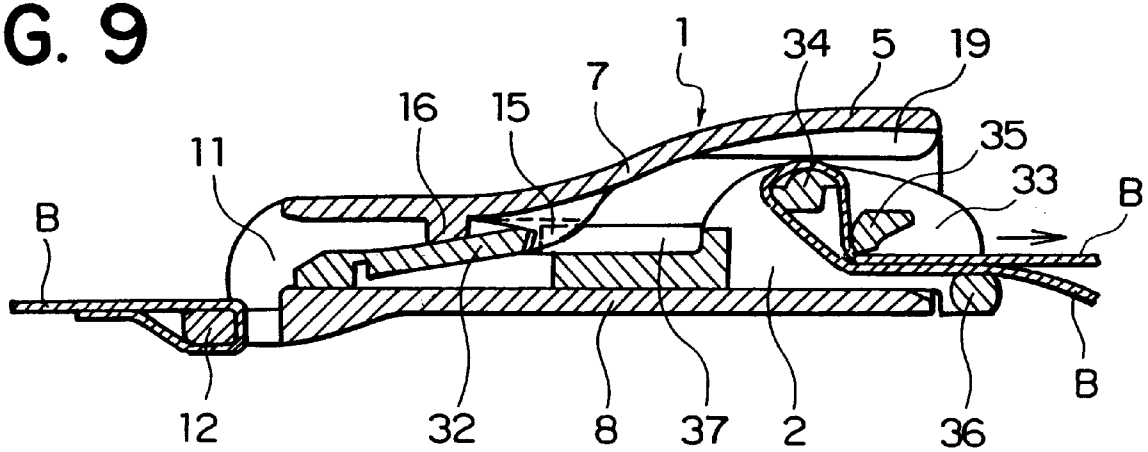
FIG. 9 is a cross sectional view showing an engaging state of the female body and the male body of the above buckle.

A usage manner of the buckle as described above will be now explained. Firstly, the belt B is attached to the belt adjusting portion 31 of the male body 2. At this time, one end of the belt B is attached to the attaching portion 12 of the housing 5 of the female body 1, while a front end of the other end thereof is hitched onto the hitching member 34 and wound around the hitching member 34 after inserted through the upper side of the placing member 36. Then the front end of the belt B is pulled out by way of a lower side of the engaging member 35. Then, in this state, the inserting plate 30 of the male body 2 is inserted from the insertion opening 10 of the housing 5 of the female body 1 as shown in FIG. 9, so that the engaged portion 32 is engaged with the engaging portion 15. In this state, an upper portion of the belt adjusting portion 31 is concealed by the upper face plate 7, and a lower portion of the belt adjusting portion 31 is concealed by the lower face plate 8. The belt B is then supported in a level state by being inserted through between the engaging member 35 and the lower face plate 8. At this time, if an upper side belt B at a side of the other end of the belt B is pulled in an arrow direction as shown in FIG. 9, the belt B is moved, so that it is possible to further fasten the belt B wound around an article (not illustrated) as far as there is a slack of the belt B. In order for the belt B to be loosened, the Belt B needs to be moved in a reversed direction of the arrow direction. However, the belt adjusting portion 31 is concealed by the housing 5, so that it is impossible to touch the belt B. Further, the belt B is supported in a level state by the lower face plate 8 and the placing member 36, 50 that it is not possible to move the belt B so as to be separated from the abutment against the belt-engaging edge portion 39 of the engaging member 35. Therefore, even when the lower side belt B is pulled, the pulling is effected so as to press the belt B against the belt-engaging edge portion 39, so that it is impossible to move the belt B to be loosen.

Figure 10:
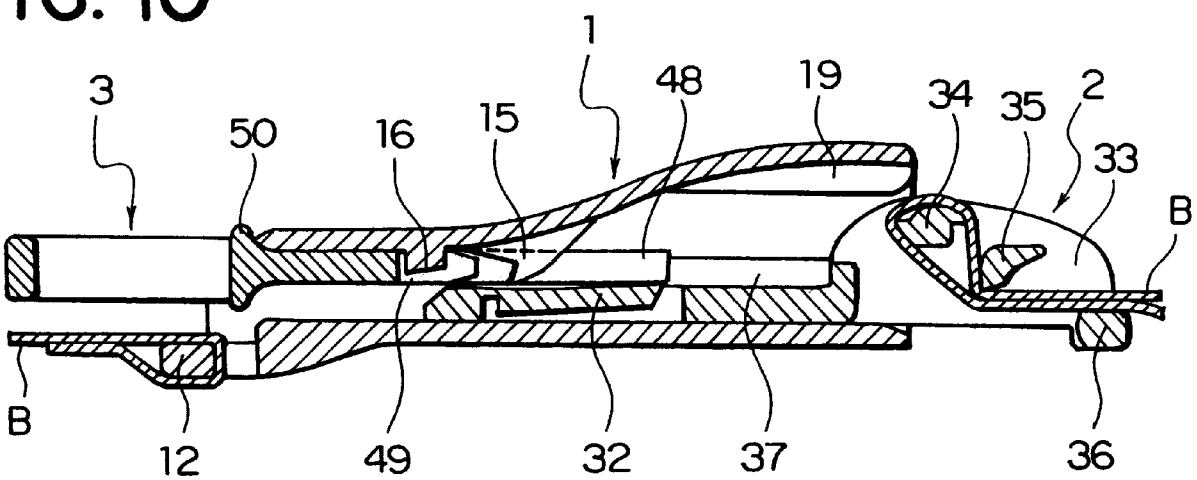
FIG. 10 is a cross sectional view showing the engaging state of the female body and the male body of the above buckle being released by a key.

In order to unlock the female body 1 and the male body 2 which are in a locking state, the key 3 is inserted from the key insertion hole 11 of the housing 5 as shown in FIG. 10, so that the engaged portion 32 of the inserting plate 30 of the male body 2 is pressed down by the right and left pressing-down leg portions 48 of the key 3 and further, the abutting portions 37, which are provided on the inserting plate 30, are pressed by front ends of the right and left pressing-down leg portions 48. As a result, the engagement of the engaging portion 15 with the engaged portion 32 can be released and the male body 2 can be pressed out and removed from the holding space 6.

In this case, the small projection 16 of the female body 1 is engaged in the notch portion 49 of the key 3. When the female body 1 and the male body 2 are in the locking state, even if a simple flat plate is inserted instead of the key 3, the front end of the flat plate is prevented from being further inserted by the small projection 16 provided in the housing 5. Therefore, such a flat plate can not release the locking. Therefore, this buckle can be kept very safe.

The small projections 16 of the female bodies 1, which are formed in the housings 5, are varied in positions or/and numbers while the shapes of the housings 5 are the same. On the other hand, the key 3 is provided with a particular number of notch portions 49 that receive the corresponding number of small projections 16 at the corresponding positions of the female body 1. Thus, each pair of the male body 2 and the female body 1 can not be disengaged from each other without the corresponding key 3.

Figure 13:
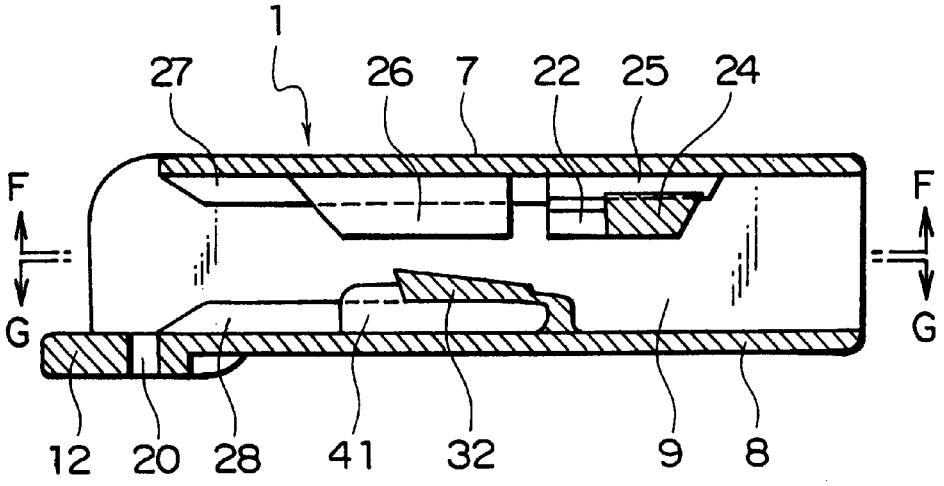
FIG. 13 is a cross sectional view taken along the line E—E of the above female body in FIG. 12.

As shown in FIGS. 12 to 16, in a buckle according to a second embodiment as shown in FIG. 11, a female body 1 is formed with a flat and tubular housing 5 provided with a holding space 6 therein. The housing 5 comprises an upper face plate 7, a lower face plate 8 and side walls 9. One end of the lower face plate 8 is protruded outward. At this protruded portion, there is provided a through hole 20 through which a belt B can be inserted, so that a belt attaching portion 12 for attaching the belt B is formed. An insertion opening 10, in which a male body 2 can be inserted, is provided at a side of the housing 5 opposite to the belt attaching portion 12. Further, a supporting member 22 having elasticity is disposed centrally so as to extend between the side walls 9 at a position near the upper face plate 7. This supporting member 22 is given with elasticity by an inflected portion 23, which is inflected in a U-shape toward the insertion opening 10, at a center thereof. As shown in FIG. 13, a pressing portion 24, which is a small piece with a front end of a reverse trapezium shape, is integrally molded to the inflected portion 23. When the male body 2 is inserted, the pressing portion 24 is formed such that it can press down a hitching member 34 on which the belt B is hitched. A key insertion hole 11 is formed at a side of the belt attaching portion 12 of the housing 5 so as to be opposed to the insertion opening 10, and the key 3 is formed such that it can be inserted in the holding space 6.

Figure 15:
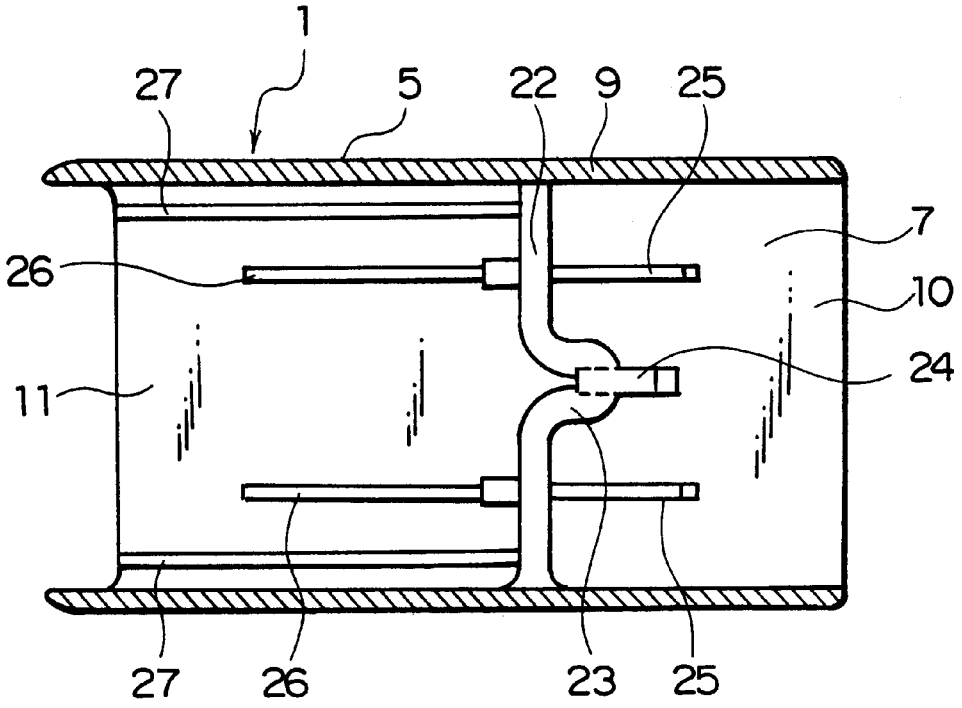
FIG. 15 is a cross sectional view taken along the line F—F of the above female body in FIG. 13.
Figure 16:
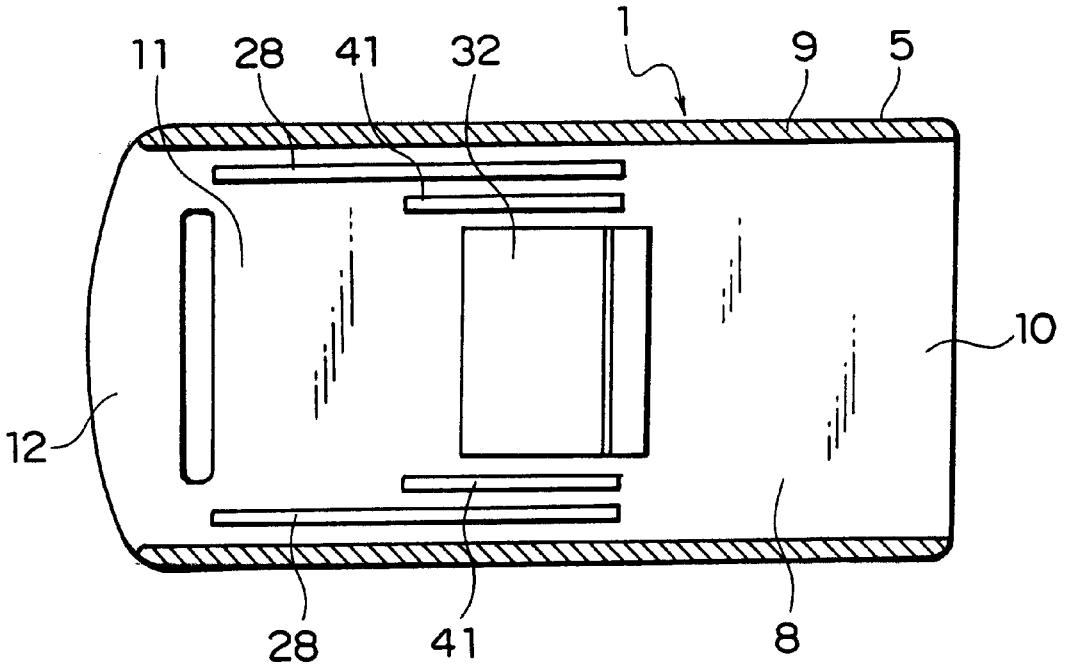
FIG. 16 is a cross sectional view taken along the line G—G of the above female body in FIG. 13.

As shown in FIG. 15, on an inner face of the upper face plate 7, a pair of guide ribs 25 for the inserting plate, which guide the inserting plate, are protruded in a middle position between the side walls 9 and the pressing portion 24 so as to extend from the supporting member 22 to the insertion opening 10. Further, a pair of deviation-preventing ribs 26 for preventing deviation of the inserting plate 30 is protruded so as to extend from the supporting member 22 to the attaching portion 12. Further, a pair of key guide ridges 27 for guiding the key 3 is disposed at an outside of the deviation-preventing ribs 26. The key 3 is inserted from the insertion hole 11 along the key guide ridges 27 and key guide ridges 28 formed on the lower face plate 8.

Figure 14:
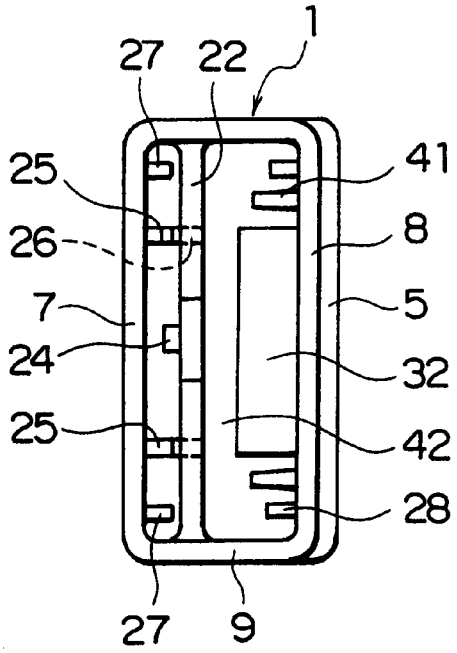
FIG. 14 is a side view of the above female body.

As shown in FIG. 14, a plate-like engaged portion 32, which has substantially the same width as a lateral space of the deviation-preventing ribs 26 provided on the upper face plate 7, is provided in an inner surface of the lower face plate 8. The plate-like engaged portion 32 has one end elastically protruded upward from the other end thereof in a direction that the inserting plate 30 is inserted as shown in FIG. 13. The engaged portion 32 is sloped in such a manner that an upper portion of the front end thereof is protruded and the lower portion of the front end is retreated, so that it is formed so as to be engaged with a hook-shaped engaging portion 15 of the inserting plate 30.

As shown in FIG. 13, a pair of blocking portions 41 are formed on opposite sides of this engaged portion 32 for preventing the inserting plate 30 from being flexed and moved down more than necessary when the engaging portion 15 and the engaged portion 32 are unlocked by the key 3. A pair of key guide ridges 28 for guiding the key 3 is disposed on the outside of the blocking portions 41 so as to correspond to the key guide ridges 27, which are disposed on the interior of the upper face plate 7.

Figure 17:
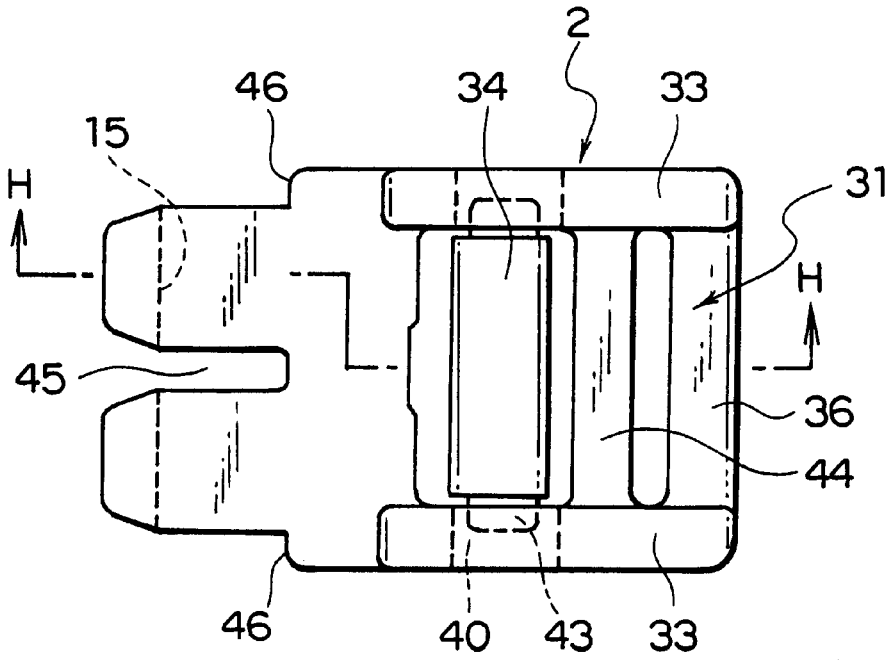
FIG. 17 is a front view of a male body of the above buckle.
Figure 18:
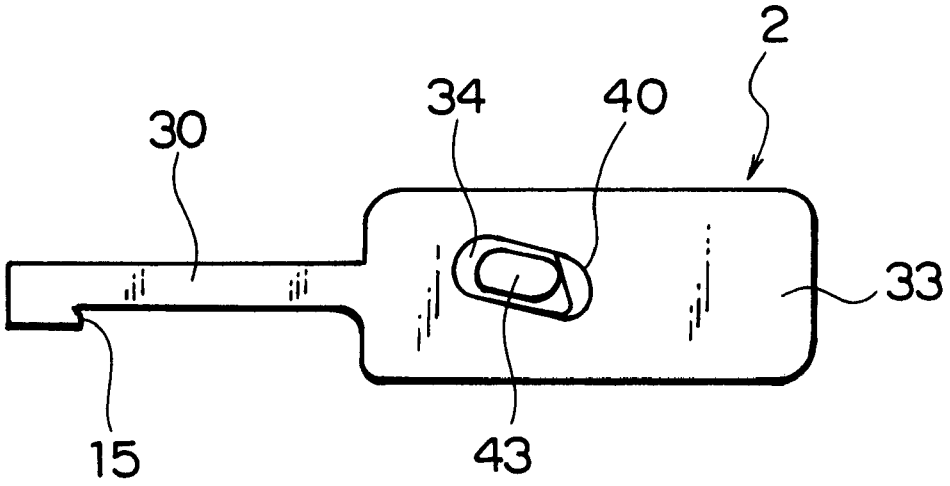
FIG. 18 is a side view of the above male body.
Figure 19:
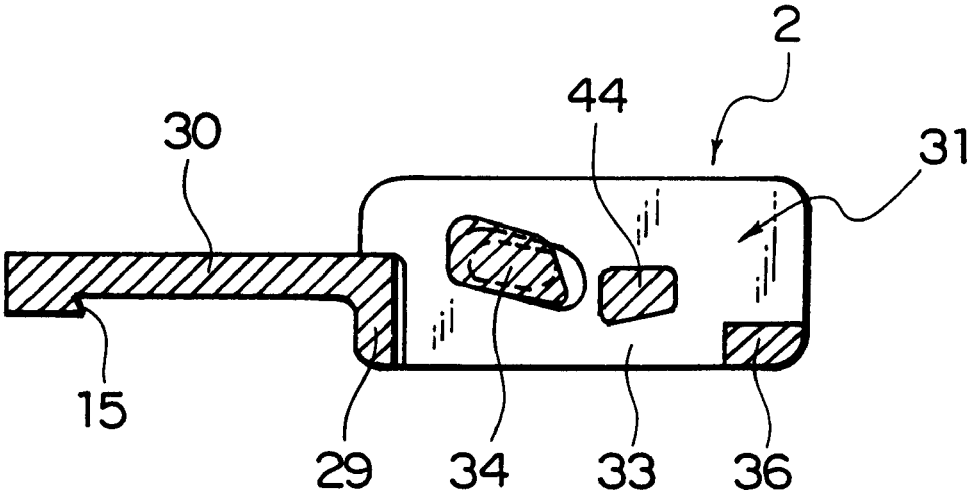
FIG. 19 is a cross sectional view taken along the line H—H of the above male body in FIG. 17.
Figure 20:
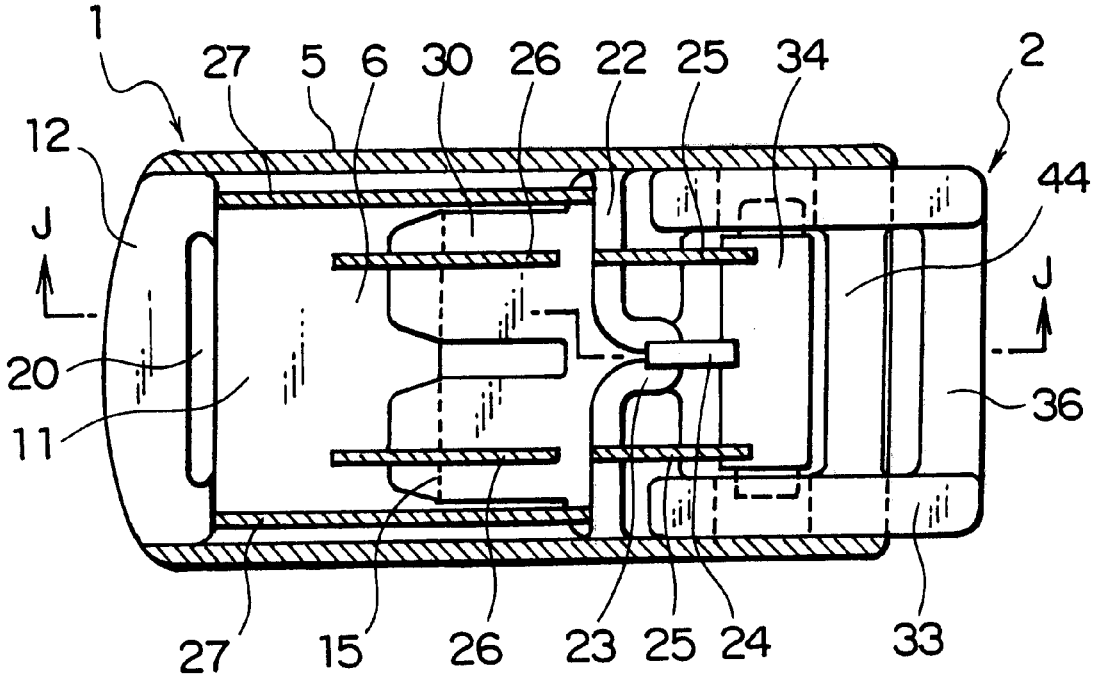
FIG. 20 is a cross sectional view taken along the line I—I in FIG. 21, showing an engaging state of the female body and the male body of the above buckle.

Next, as shown in FIGS. 17 to 19, the male body 2 is provided with a pair of supporting walls 33, which is protruded higher than a base member 29, on opposite sides of the base member 29. A belt adjusting portion 31 for adjusting a length of the belt B is formed at the supporting walls 33. As shown in FIG. 19, this belt adjusting portion 31 is provided with a hitching member 34 for hitching the belt B thereon, which is disposed near the base member 29 so as to slope down from the base member 29 to the outside, and a pair of guide holes 40 for guiding a hitching member 34. The hitching member 34 has an axis 43 disposed at opposite ends thereof, which is freely engaged in the guide holes 40 so that the hitching member 34 can be obliquely moved along the guide holes 40. The belt adjusting portion 31 is further formed with a folding member 44, which folds the belt B thereon, obliquely downward of the guide holes 40 at a substantially center of the supporting wall 33. Further, the belt adjusting portion 31 is formed with a placing member 36, which places the belt B inserted through lower portions of back ends of the supporting walls 33.

Further, the plate-like inserting plate 30 is protruded from an upper end of the base member 29 in a forward direction. The inserting plate 30 is provided with a cut-out portion 45 at a center thereof, into which a pressing portion 51 formed in a center of the key 3 and having a sharp taper is capable of being inserted. A pair of notch portions 46, in which a pair of projecting portions 52 protruded a opposite sides of the key 3 can be engaged, is formed at opposite sides of the inserting plate 30, so that the key 3 is capable of being inserted in the housing 5 in a stable fashion. Further, as shown in FIG. 19, the engaging portion 15 protruding downward in a hook shape is provided on a lower face of a front end of the inserting plate 30, which is formed in a two-forked shape. Therefore, when the inserting plate 30 is inserted in the housing 5, the engaging portion 15 can be engaged with the engaged portion 32 provided in the housing 5.

In addition, the engaging portion 15 of the male body 2 may be provided on an upper face of the inserting plate 30 while the engaged portion 32 of the female body 1 is provided on the upper face plate 7.

As shown in FIG. 11, the key 3 is provided with a narrow and long pressing portion 51, which is protruded on a center of a flat base plate 53 of the key 3 and which can be inserted in the housing 5. The pressing portion 51 has a taper with its front end being sharp and is capable of pressing down the engaged portion 32. Further, the pair of projecting portions 52, which are protruded in a forward direction, are formed at the opposite sides of the key 3, so that the projecting portions 52 are capable of being inserted in the notch portions 46 of the inserting plate 30.

Figure 21:
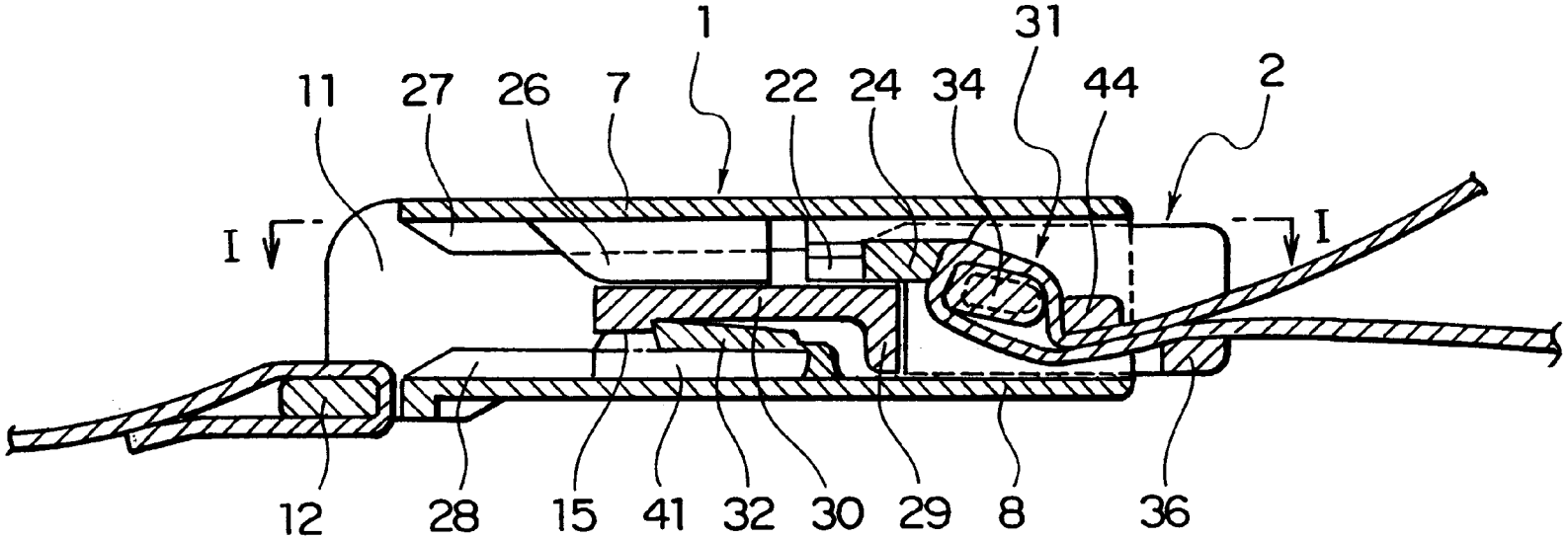
FIG. 21 is a cross sectional view taken along the line J—J of the above buckle in FIG. 20.
Figure 22:
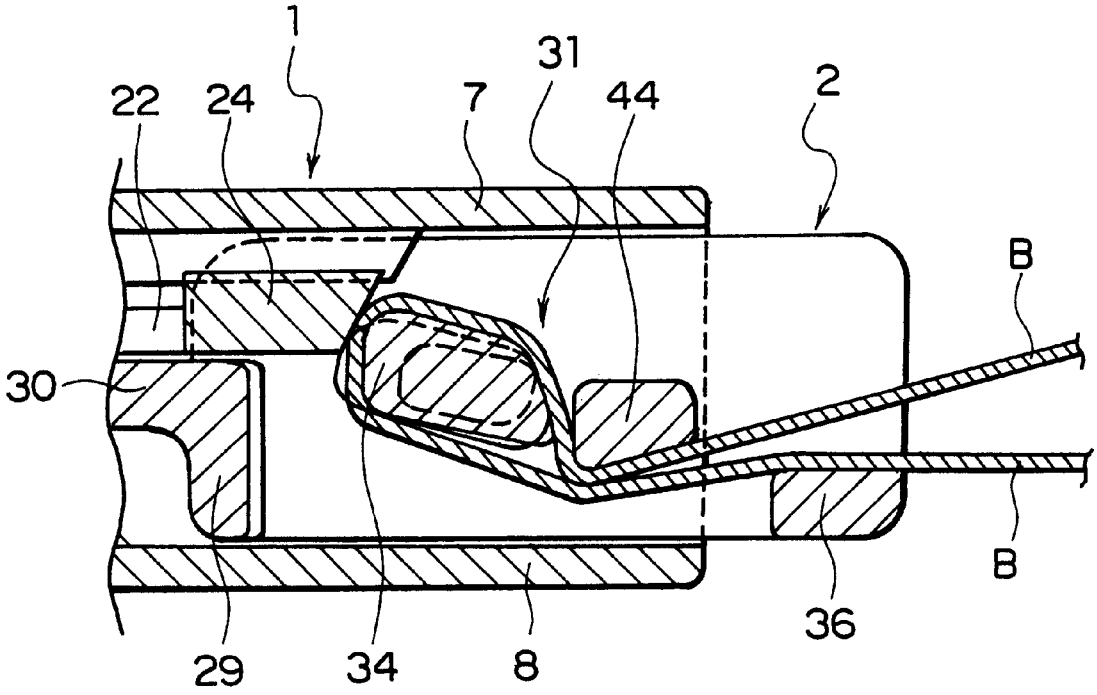
FIG. 22 is an enlarged cross sectional view of a main portion showing an operation of a movable adjusting portion of the above buckle.

The female body 1, the male body 2 and the key 3 are formed as described above. The usage manner of these members will be now explained. One end of the belt B is attached to the attaching portion 12 provided at one end of the female body 1, and the other end of the belt B is wound around the hitching member 34 via the placing member 36 of the male body 2 and hitched onto the hitching member 34, and then the belt B is superimposed on each other under the folding member 44 and the belt B is pulled to the outside to be fastened. In this state, when the inserting plate 30 is inserted from the insertion opening 10 of the housing 5 of the female body 1 as shown in FIG. 21, the pressing portion 24 provided on the supporting member 22 elastically presses down the hitching member 34 via the belt B. When the inserting plate 30 is further inserted, the engaging portion 15 is engaged with the engaged portion 32 of the housing 5. At the same time, the pressing portion 24 smoothly moves the hitching member 34 in the guide holes 40, so that the belt B hitched on the hitching member 34 press and contacts the folding member 44 as shown in FIG. 22. In this state, the belt adjusting portion 31 is concealed by the housing 5. As a result, as is the same as the aforementioned first embodiment, the operation for loosing the belt B can not be carried out.

When the female body 1 and the male body 2 are locked with each other by the engagement of the engaging portion 15 and the engaged portion 32, in order to unlock them, the key 3 is inserted from the key insertion hole 11, and the engaged portion 32 is pressed down by the front end of the pressing portion 51 provided on the center of the key 3. As a result, the engagement of the engaging portion 15 and the engaged portion 32 are released, so that it is possible to separate and release the male body 2 and the female body 1. Thus, the male body 2 can be freely detached from the female body 1.

Figure 25:
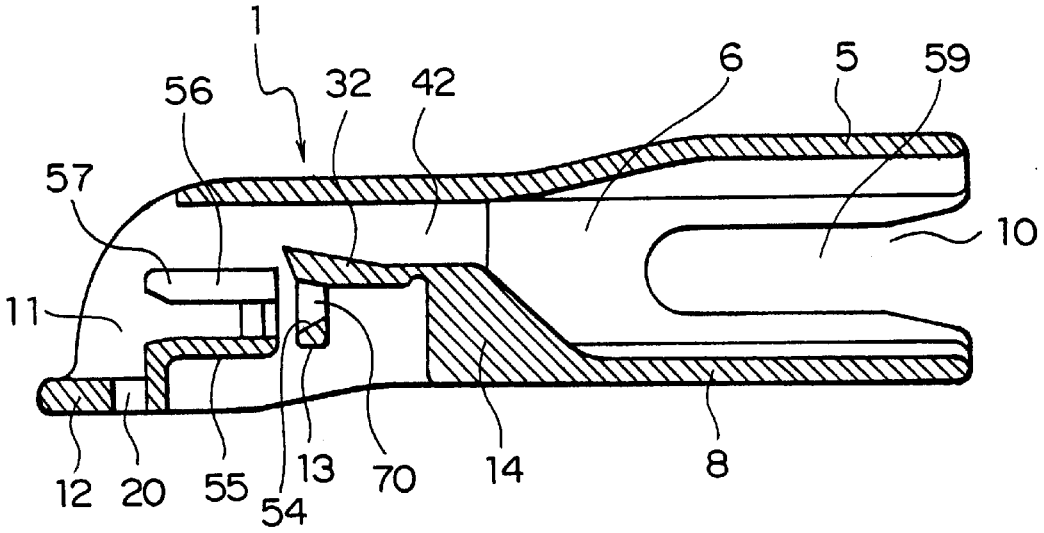
FIG. 25 is a cross sectional view taken along the line K—K of the above female body in FIG. 24.
Figure 26:
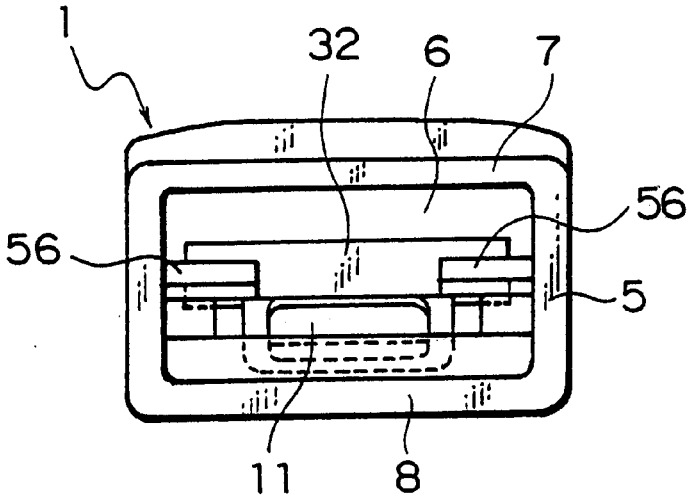
FIG. 26 is a side view of the above female body.

As shown in FIGS. 23 to 26, in a buckle according to a third embodiment as shown in FIG. 23, a female body 1 is formed with a flat and tubular housing 5 provided with a holding space 6 therein. The housing 5 comprises an upper face plate 7, a lower face plate 8 and side walls 9. One end of the lower face plate 8 is protruded outward. At this protruded portion, there is provided a through hole 20 through which a belt B can be inserted, so that a belt attaching portion 12 for attaching the belt B is formed. An insertion opening 10, in which a male body 2 can be inserted, is provided at a side of the housing 5 opposite to the belt attaching portion 12. Further, a base table 14 is formed between both the side walls 9 in the housing 5. The base table 14 is formed in such a manner that the height thereof is substantially half of the height of the side walls 9 and its one side toward the insertion opening 10 slopes so that an inserting plate 30 of the male body 2 is capable of being smoothly inserted therein. An engaged portion 32 is provided at an upper end of the base table 14 extending in an insertion direction such that it is elastically protruded from the upper end. A front end of this engaged portion 32 is protruded rather upward. The front end of the engaged portion 32 slopes such that its upper end is protruded while its lower end is retreated. As shown in FIGS. 25 and 26, a plate-like pending portion 13, which is provided with a hole 70 having substantially the same shape as the key 3, is integrally molded on a lower surface of the front end of the engaged portion 32. A lower surface of the hole 70 of the engaged portion 32 is formed into a taper surface 54 so that an inlet of the hole 70 can be wider. Therefore, the engaged portion 32 is capable of being moved down by insertion of a flat key 3. Further, a passageway portion 42, in which the inserting plate 30 is capable of being inserted, is defined between the engaged portion 32 and the upper face plate 7. A key insertion hole 11 is defined on the side of the belt attaching portion 12 of the housing 5 so as to be opposed to the insertion opening 10, so that the key 3 is capable of being inserted in the holding space 6.

In front of the engaged portion 32 in the housing 5, a hook-like guide table 55 for guiding the key 3 to be inserted into the housing 5 is provided extending between the side walls 9 in such a manner that the height of the guide table 55 is the same as that of the taper surface 54 of the lower face of the hole 70 provided in the pending portion 13. A pair of guide ridges 56, which are protruded from the side walls 9 with a space corresponding to the thickness of the key 3, is provided above the guide table 55. The key 3 moves between the guide table 55 and the guide ridges 56 so that the key 3 is correctly inserted into the hole 70. Further, the guide ridges 56 are formed with blocking portions 57 for blocking the front end of the inserting plate 30 from moving down together with the engaged portion 32 due to abutment with the engaged portion 32 when the key 3 is inserted into the hole 70 and the engaged portion 32 moves down. Therefore, the engagement of the inserting plate 30 and the engaged portion 32 can be accurately released.

A pair of guide grooves 59, which open in a longitudinal direction of the housing 5, are respectively defined on the side walls 9 at a side toward the insertion opening 10 of the housing 5. The guide grooves 59 enable a projecting portion 58 provided on a belt adjusting portion 31 of the male body 2 to smoothly slide, so that the male body 2 can be smoothly released from the female body 1. Further, the upper face plate 7 expands to the surface in a range of the insertion opening 10 and the guide grooves 50, so that the male body 2 is capable of being inserted in a belt adjusting portion 31.

Figure 27:
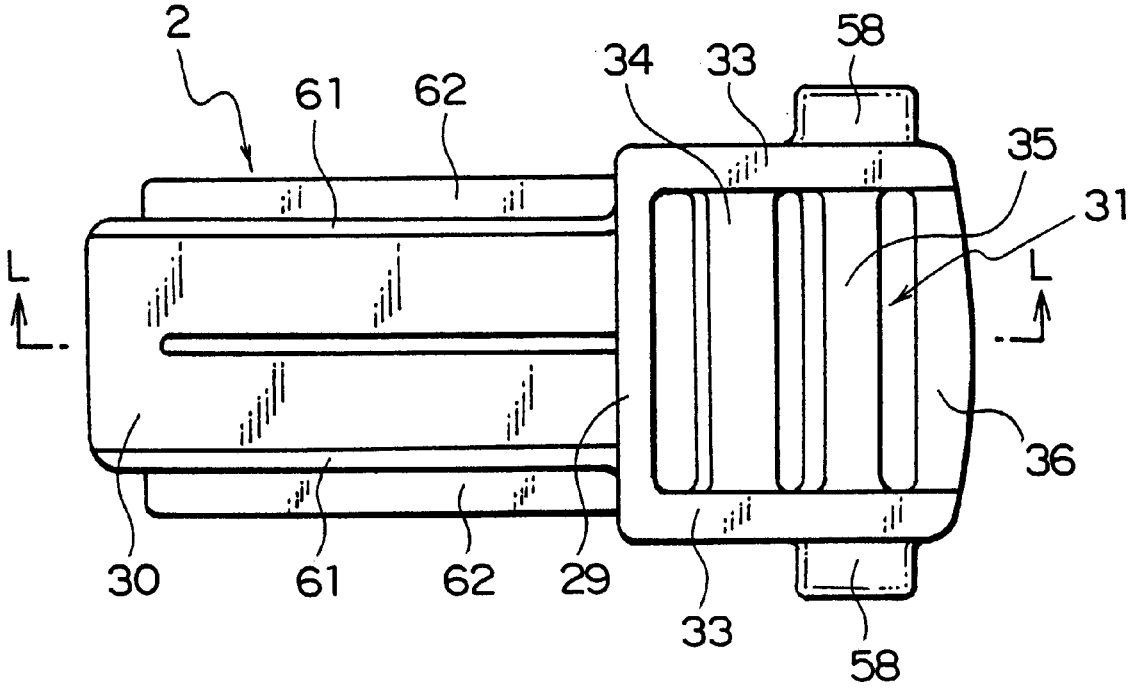
FIG. 27 is a front view of a male body in the above buckle.
Figure 28:
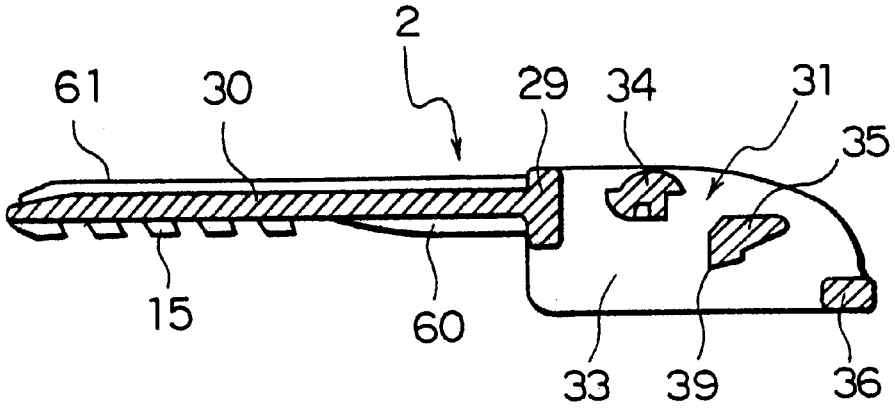
FIG. 28 is a cross sectional view taken along the line L—L of the above male body in FIG. 27.

On the other hand, as shown in FIGS. 27 and 28, in the male body 2, the inserting plate 30, which is a flat plate-like shape, is protruded forward of the base member 29. As shown in FIG. 28, a plurality of hook-shaped engaging portions 15, which are provided on a lower surface of the inserting plate 30 with a predetermined space, arranged from the front end of the inserting plate 30, so that the engaging portions 15 are capable of being engaged with the engaged portion 32 of the female body 1. These engaging portions 15 slope so as to protrude against the insertion direction of the inserting plate 30, i.e. protruded in a straight line direction which crosses an axis of the insertion direction at a sharp angle. A pair of reinforcing portions 60, which are protruded at the same height as that of the engaged portion 32, are provided on both sides of a base end of the inserting plate 30, correspondingly to the base member 29. Further, a pair of reinforcing ridge portions 61 are protruded at both sides of the upper surface of the inserting plate 30 in order to reinforce the inserting plate 30. In addition, the inserting plate 30 is provided with a pair of overhanging portion 62, which overhangs outward of the reinforcing ridge portions 61 of the upper surface of the inserting plate 30 and the reinforcing portions 60 of the lower surface thereof, so that the inserting plate 30 is capable of being inserted and held in the passageway portion 42 in the housing 5 in a stable fashion.

A pair of supporting walls 33 are disposed at opposite ends of the base member 29 and at the back of the male body 2. Each of the supporting walls 33 is formed of a thick plate body provided with a portion projecting lower than the base member 29. A hitching member 34 for winding and hitching a belt B thereon is disposed between the supporting walls 33 at a portion near the base member 29. This hitching member 34 is provided with projecting ridges at the front and back thereof, which are formed in a staggered manner so that the belt B is prevented from being slipped therefrom. An engaging member 35 is disposed substantially centrally of the side walls 33 at a position obliquely behind of the hitching member 34. The engaging member 35 is provided with a belt-engaging edge portion 39 having a sharp angle, which is capable of fastening the belt B on its end portion. As a result, a belt adjusting portion 31, which is capable of adjusting the length of the belt B, is formed. Further, a placing member 36, which is capable of placing the inserted belt B, is disposed at the lower end portions of the back of the supporting walls 33.

Figure 29:
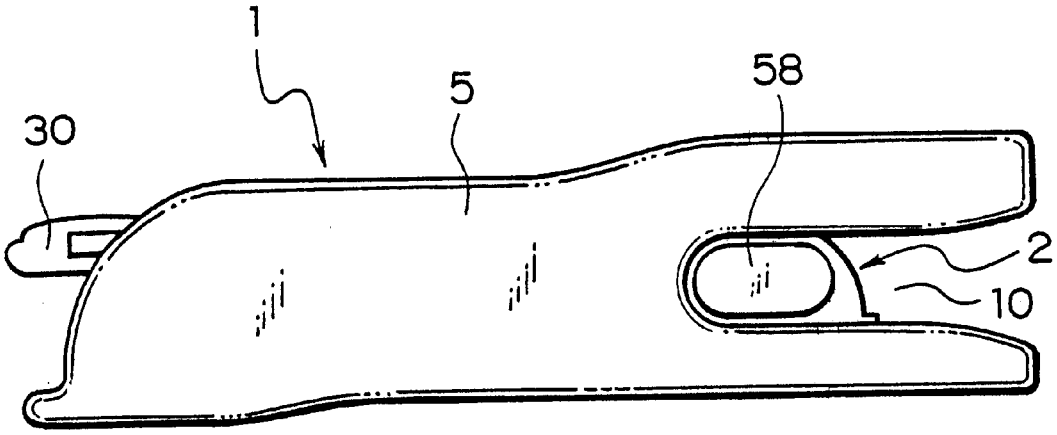
FIG. 29 is a side view showing an engaging state of the female body and the male body of the above buckle.

As shown in FIG. 29, a pair of projecting portions 58 are protrusively provided on outside surfaces of the supporting walls 33. The projecting portions 58 are capable of being inserted in the guide grooves 59 formed on the housing 5 of the female body 1 to be smoothly moved therein. Further, the projecting portions 58 are protruded outward and large enough to be held by hand. Therefore, in operation, the male body 2 can be easily released from the male body 1. Alternatively, the engaging portions 15 of the male body 2 may be provided on the upper face plate 7. Further, the engaged portion 32 of the female body 1 may be provided on the upper surface of the inserting plate 30. Additionally, as shown in FIG. 23, the key 3 is formed of a flat plate body and provided with an insert portion 63, of which front end is narrow, so that the key 3 is capable of being easily inserted in the hole 70 of the pending portion 13, which is disposed on the lower surface of the front end of the engaged portion 32, shown in FIGS. 25 and 26.

Figure 30:
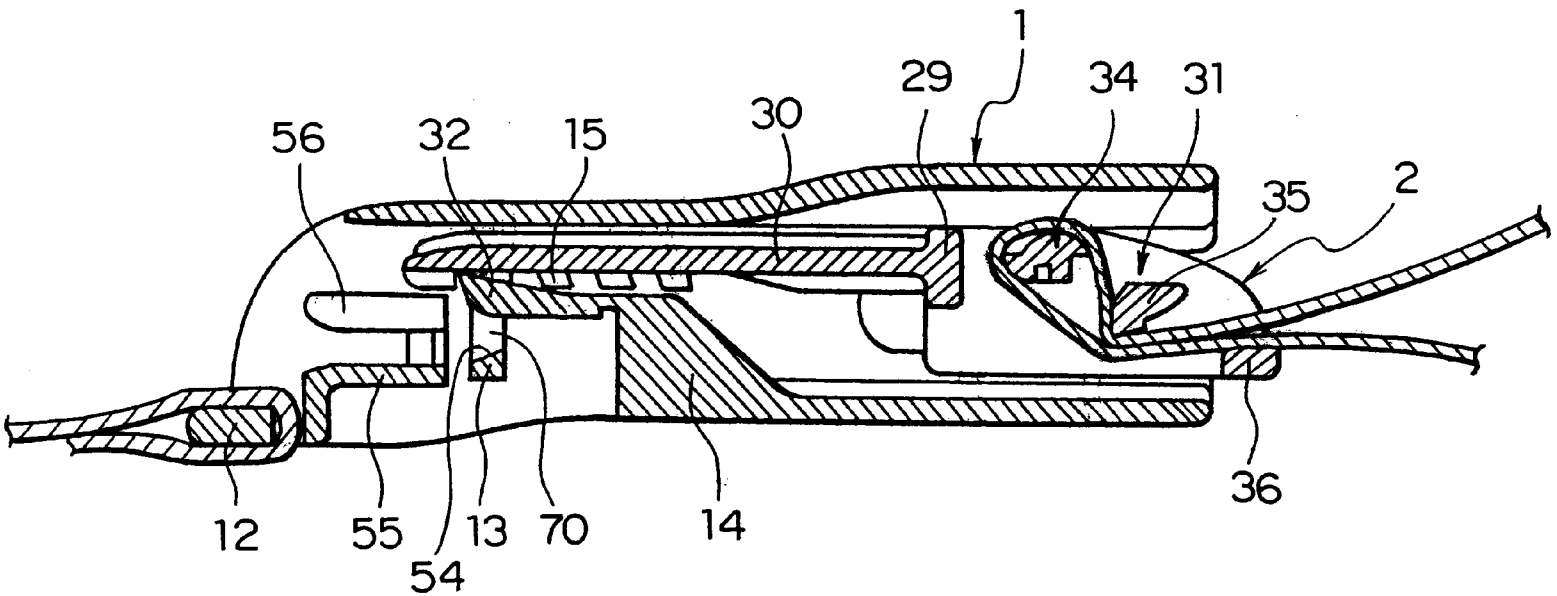
FIG. 30 is a cross sectional view showing a primary engaging state of the female body and the male body of the above buckle.

The usage manner of the female body 1, the male body 2 and the key 3 will be now explained. As shown in FIG. 30, one end of the belt B is attached to the attaching portion 12 provided on the housing 5 of the female body 1, and the other end of the belt B passes through the lower side of the engaging member 35 after passing on the placing member 36 of the male body 2. Then, the belt B is would and hitched on the hitching member 34 and then the front end of the belt B passes through the lower side of engaging member 35 again. Then, the belt B is superimposed on each other at the belt-engaging edge portion 39. After that, the inserting plate 30 is inserted from the insertion opening 10 of the housing 5 in a state that the belt B is strained and pulled to the outside, until one of the engaging portions 15 of the inserting plate 30 is engaged with the front end of the engaged portion 32. As the inserting plate 30 is pushed forward, an arbitrary one of the engaging portions 15 is engaged with the engaged portion 32 so that the belt B wound around an article (not illustrated) can be fastened. Then, by pulling the other end of the belt B, the belt B is completely strained. In this case, the belt adjusting portion 31 is held in the housing 5, so that it is concealed.

Figure 31:
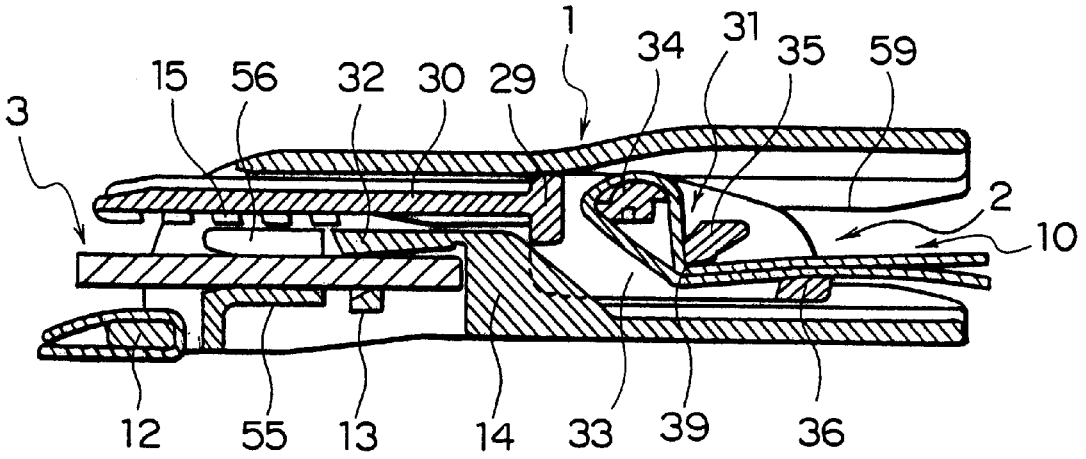
FIG. 31 is a cross sectional view showing a releasing state carried out by a key of the above buckle.

As shown in FIG. 31, in order to release the locking state of the female body 1 and the male body 2 of the strained belt B, the insert portion 63 of the key 3 is inserted from the key insertion hole 11 into the hole 70 of the pending portion 13 through the guide table 55 of the housing 5. Then, the front end of the engaged portion 32 is moved down by the taper surface 54 of the hole 70, and the inserting plate 30 abuts against and supported by the guide ridges 56, so that the engaging portions 15 are released from the engaged portion 32. Then, the inserting plate 30 is released from the housing 5 by holding the projecting portions 58 of the male body 2. As a result, the female body 1 and the male body 2 can be separated and released from each other.

In a state that the belt adjusting portion 31 is held in the housing 5, the belt B is capable of being further fastened, however, the operation for loosening the belt B can not be carried out, similarly to the aforementioned first and second embodiments.

Figure 33:
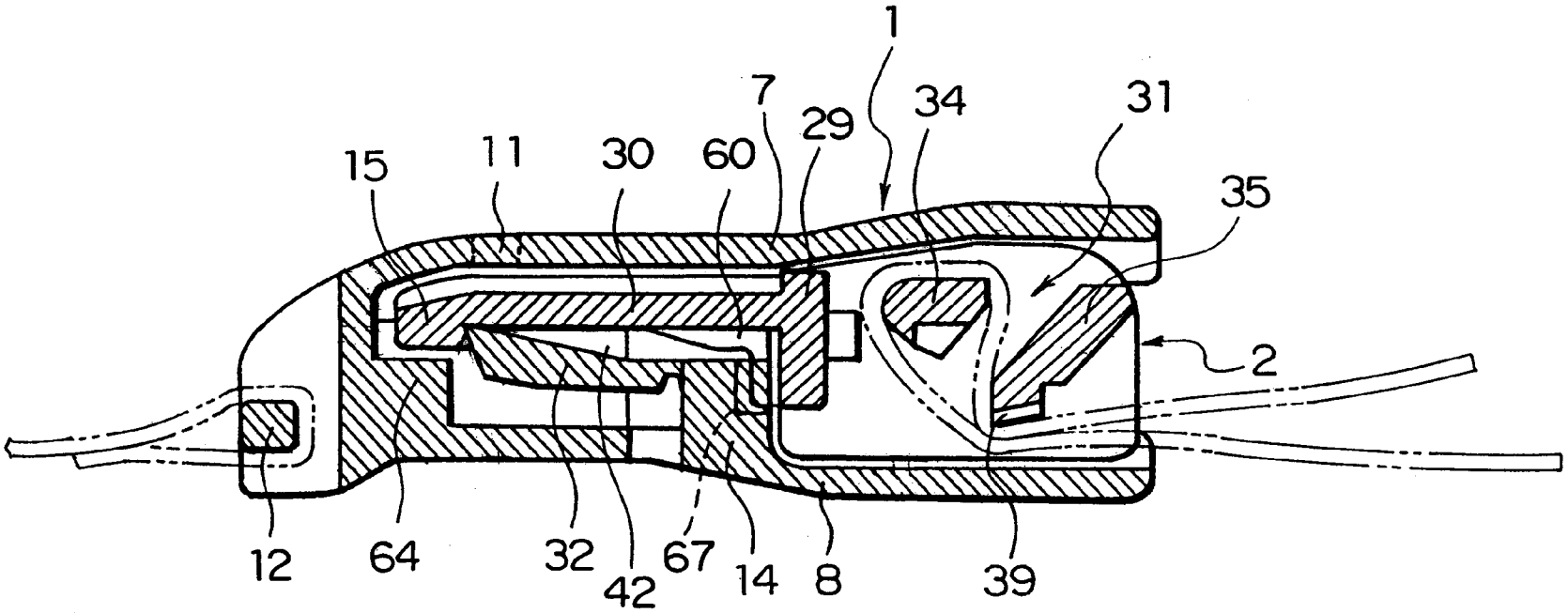
FIG. 33 is a cross sectional view showing an engaging state of a female body and a male body of the above buckle.

In a buckle according to a fourth embodiment shown in FIGS. 32 and 33, a female body 1 is formed with a flat and tubular housing 5, which is provided with a holding space 6 therein. The housing 5 comprises an upper face plate 7, a lower face plate 8 and side walls 9. The housing 5 is provided with an insertion opening 10 at one end thereof and is sealed at the other end thereof opposing to the insertion opening 10. A base table 14 is disposed in a middle part of the lower face plate 8. An engaged portion 32 is protruded from an upper end of the base table 14 in an insertion direction of the inserting plate 30 with one end thereof being elastically protruded upward from the other end thereof. A passageway portion 42 of the inserting plate 30 is formed on the engaged portion 32 and the front end of the engaged portion 32 is formed at a sharp angle. Further, in front of the engaged portion 32, placing tables 64 having the same height as that of the base table 14 are provided in corners of the engaged portion 32 to form blocking portions 65, so that the front end of the inserting plate 30 is capable of being placed on the blocking portions 65. A pair of insert holes 11 for the key 3 are provided at the right and left sides of the upper face plate 7 above the upper front end of the engaged portion 32, such that the opposite sides of the engaged portion 32 are capable of being pressed down by the key 3 in a two-forked shape. Further, a guide groove 59, with which a projecting portion 58 of the male body 2 is capable of being engaged, is formed on each of the side walls 9 on the side of the insertion opening 10, as shown in FIG. 32. An attaching portion 12 for attaching the belt B is formed at one side of the housing 5 opposite to the insertion opening 10.

On the other hand, as shown in FIG. 33, in the male body 2, a plate-like inserting plate 30, of which width is narrower than that of the engaged portion 32, is protruded forward from a base member 29. A hook-shaped engaging portion 15 is provided on a front end of a lower surface of the inserting plate 30 so as to be engaged with the engaged portion 32. A pair of supporting walls 33 are connected to opposite sides of a back portion of the base member 29. A hitching member 34, which is capable of winding and hitching the belt B thereon, is disposed between the supporting walls 33 at a position near the base member 29. Further, an engaging member 35, which is provided with a belt-engaging edge portion 39 capable of engaging with the belt B, is disposed obliquely below the hitching member 34 so as to be opposed to the hitching member 34. Thus, a belt adjusting portion 31, which is capable of adjusting a length of the belt B, is formed. This belt adjusting portion 31 is formed so as to be held in the housing 5.

A projecting portions 58, which is capable of being engaged with the guide groove 59 provided in the housing 5 of the female body 1, is protruded on each of outer side surfaces of the side walls 33 so that the male body 2 can be easily held by hand. Further, a hook-shaped reinforcing portion 60 is provided at a connecting portion of the base member 29 and the inserting plate 30, so that the reinforcing portion 60 is capable of being engaged with a recess 67, which is defined on the base table 14 of the housing 5.

The usage manner of this buckle will be now explained. The belt B is inserted in the hitching member 34 and the engaging member 35, which constitutes the adjusting portion 31 of the male body 2. Then, while the belt B is strained by pulling, the inserting plate 30 is inserted from the insertion opening 10 of the female body 1. Then, as the inserting plate 30 is pushed, the engaging portion 15 of the inserting plate 30 and the engaged portion 32 of the female body 1 are engaged with each other, so that it is locked. In this locked situation, since the belt adjusting portion 31 is held in the housing 5 to be concealed from the outside, the belt B disposed in the adjusting portion 31 can never be loosened, while it is possible to pull and fasten the belt B.

Figure 34:
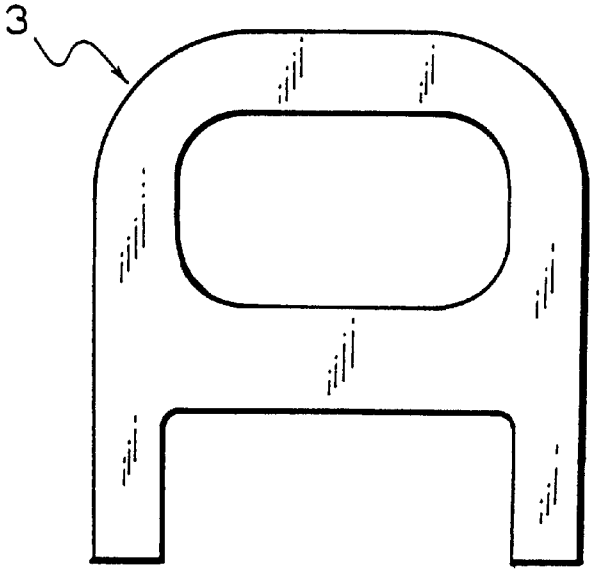
FIG. 34 is an enlarged front view of a key to be used in the above buckle.

In order to unlock the engaged and locked situation of the female body 1 and the male body 2 by using the key 3, the key 3 in a two-forked shaped as shown in FIG. 34 is inserted into the insertion holes 11 defined on the upper face plate 7 of the housing 5 so that the front end of the key 3 presses down the both sides of the front end of the engaged portion 32 while staying away from the inserting plate 30. Then, the front end of the inserting plate 30 is held by the blocking portions 65 of the placing tables 64, so that the engaging state of the engaged portion 32 and the engaging portion 15 is released. As a result, the inserting plate 30 can be freely released from the housing 5.

Figure 36:
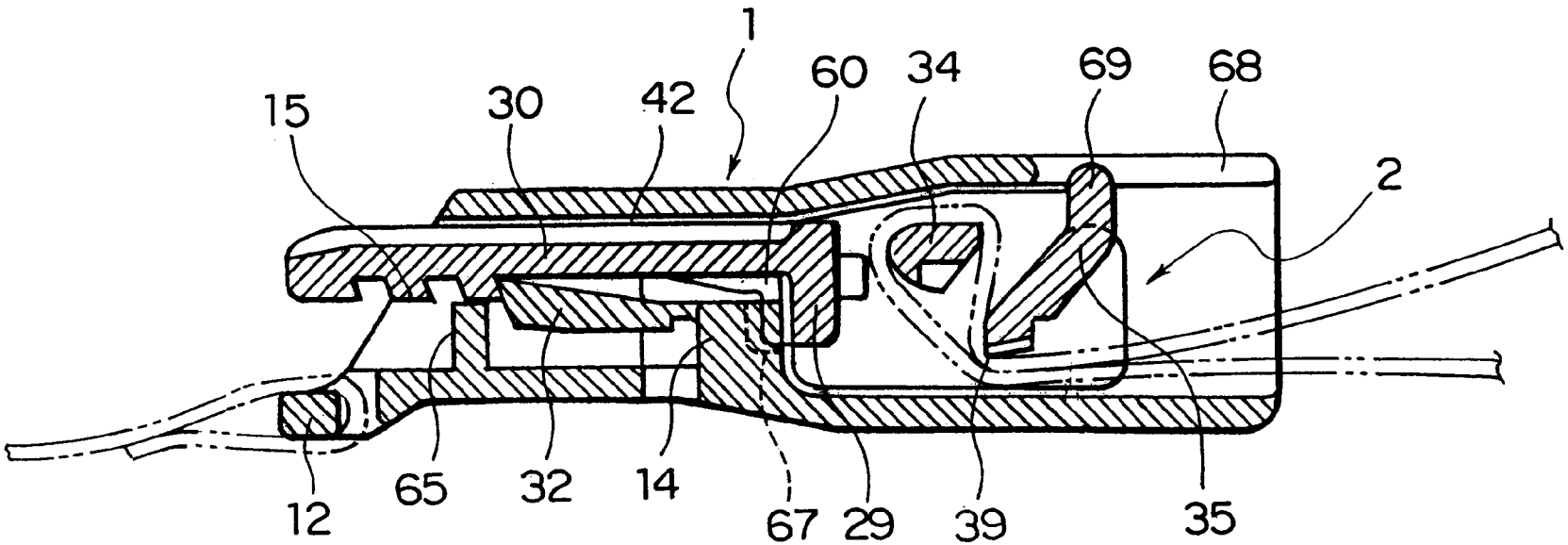
FIG. 36 is a cross sectional view taken along the line M—M of the above male body in FIG. 35.
Figure 37:
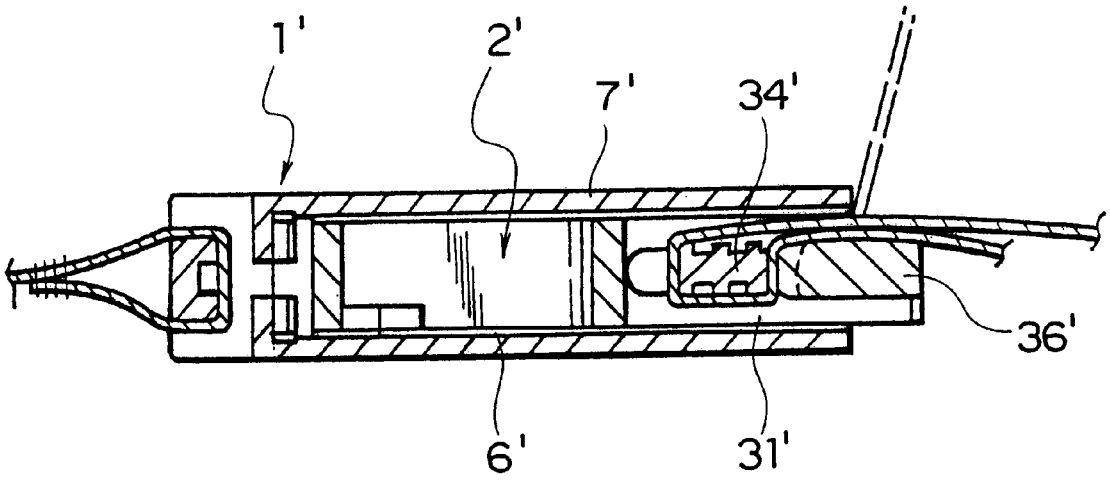
FIG. 37 PRIOR ART
FIG. 37 is a cross sectional view showing a state in which a female body and a male body of a well known buckle are engaged with each other.

According to a buckle of a fifth embodiment shown in FIGS. 35 and 36, a housing 5 of a male body 1 is rather long rectangular and it is formed of an upper face plates 7, a lower face plate 8 and side walls 9. In a middle portion of the housing 5, a base table 14 is disposed on the lower face plate 8 between the side walls 9. A tongue-shaped engaged portion 32 having elasticity is protruded extending from an upper end of the base table 14 to an end portion of the housing 5. A passageway portion 42 for the inserting plate 30 is formed above the engaged portion 32. A front end of the engaged portion 32 is formed at a sharp angle. A blocking portion 65 protruded with the same height as that of the base table 14 is provided in front of the engaged portion 32 so as to block the downward oscillation of the inserting plate 30. Further, a through hole 20 of the belt B is defined on a front end of the lower face plate 8 so as to form an attaching portion 12. A pair of insertion holes 11, in which the key 3 is capable of being inserted, are separately defined at both of right and the left sides of the upper face plate 7, correspondingly to the front end of the engaged portion 32, so that the both sides of the engaged portion 32 is capable of being pressed down by the two-forked key 3. A guide groove 68, which opens in a longitudinal direction of the buckle 1, is provided on the upper face plate 7 on the side of the insertion opening 10. A projecting portion 69, which is protruded on a top of the engaging member 35 of the male body 2, is formed so as to be slid in the guide groove 68.

In the male body 2, a flat plate-like inserting plate 30 is protruded on a front surface of the base member 29 and a plurality of hook-shaped engaging portions 15 are arranged on a lower surface of the inserting plate 30 so that the engaging portions 15 are capable of being engaged with the engaged portion 32. A pair of supporting walls 33 are connected to both sides of the base member 29. A hitching member 34, which is capable of winding and hitching the belt B thereon, is disposed between the supporting walls 33 at a position near the base member 29. Further, an engaging member 35, which is provided with a belt-engaging edge portion 39 capable of fastening the belt B, is disposed obliquely below the hitching member 34 so as to be opposed to the hitching member 34. A projecting portion 69, which is capable of slide in a guide groove 68 defined on the upper face plate 7, is formed on a top of the engaging member 35. Therefore, a belt adjusting portion 31 capable of adjusting a length of the belt B is constituted by the hitching member 34 and the engaging member 35. This belt adjusting portion 31 is formed in such a manner that, by letting the projecting portion 69 formed on the top of the engaging member 35 slide in the guide grove 68, the projecting portion 69 can be held deeply in the housing 5. Furthermore, a pair of key-shaped reinforcing portions 60 are disposed at the both sides of a connecting portion of the base member 29 and the inserting plate 30 so as to be engaged in recesses 67, which are provided at both ends of the base table 14 in the housing.

The usage manner of the buckle will be now explained. The belt B is inserted in the hitching member 34 and the engaging member 35 of the adjusting portion 31 provided in the male body 2 so that the belt B is set. In this state, the inserting plate 30 of the male body 2 is inserted from the insertion opening 10 of the female body 1, so that the engaging portion 15 of the inserting plate 30 and the engaged portion 32 of the female body 1 are engaged with each other to be locked. In this locking state, the belt B set in the adjusting portion 31 can never be loosened, while it is possible to fasten the belt B by pulling.

In order to unlock the engaged and locked situation of the female body 1 and the male body 2 by using the key 3, the two-forked key 3 is inserted in the insertion holes 11 defined on the upper face plate 7 of the housing 5, so that the both sides of the front end of the engaged portion 32 are pressed down. Then, the front end of the inserting plate 30 is prevented from being moved down by the blocking portions 65, so that the engaging portion 15 is released from the engaged portion 32. As a result, the locking is released and the inserting plate 30 can be freely released from the housing 5.

While particular embodiments of the present invention have been illustrated and described, it would be obvious to those skilled in the art that various other changes and modifications can be made without departing from the sprit and scope of the present invention. It is intended to cover in the appended claims all such changes and modifications that are within the scope of the present invention.

What is claimed:

1. A buckle including a female body and a male body, wherein said female body is formed with a holding space for holding said male body in a housing having an upper face plate and a lower face plate; an insertion opening for insertion of said male body and a key insertion hole, both of which communicate with said holding space, are provided in said housing; a belt attaching portion is provided at an end of said housing opposing to said insertion opening; said male body is provided with a belt adjusting portion at a base end of an inserting portion; an engaging portion is provided on either one of said housing and said inserting portion; an engaged portion, which is elastically deformable, is provided on the other one of said housing and said inserting portion; wherein when said inserting portion is inserted in said housing, said engaging portion and said engaged portion are engaged with each other and said belt adjusting portion is inserted into the holding space, which exists between the upper face plate and the lower face plate of the housing, and is concealed by said housing; and wherein when said inserting portion is pulled out from said housing, said engaged portion is elastically deformed by insertion of a key to release said engagement of the engaging portion and said engaged portion.

2. A buckle according to claim 1, wherein said key insertion hole is provided at the one end of said housing opposing to said insertion opening (10) for insertion of the male body.

3. A buckle according to claim 1, wherein said key insertion hole is formed in a direction orthogonal to an insertion direction of said male body in said housing.

4. A buckle according to claim 1, wherein said engaging portion has a hook shape and is protruded on an upper face plate of said housing of said female body, and said engaged portion is provided on a surface of said inserting portion with one end thereof being elastically protruded upward from the other one end thereof.

5. A buckle according to claim 1, wherein said engaged portion is provided on a lower face plate of said housing of said female body with one end thereof being elastically protruded in an insertion direction of said male body from the other one end thereof, and said engaging portion has a hook shape and is protruded on a rear surface of said inserting portion.

6. A buckle according to claim 1, wherein a base table is provided on a lower face plate of said housing of said female body, a passageway portion for said inserting portion is formed between said base table and an upper face plate of said housing; said engaged portion is provided on said base table with one end thereof being elastically protruded in an insertion direction of said male body from the other one end thereof; and said engaging portion has a hook shape and is protruded on a rear surface of said inserting portion.

7. A buckle according to claim 1, wherein said belt adjusting portion of said male body comprises a pair of supporting walls, a hitching member for hitching a belt thereon and an engaging member for engaging with the belt or a folding member for folding the belt, both of which are disposed between the pair of supporting walls; and the belt passes through between said engaging member or said folding member and a lower face plate of said housing when the male body is inserted into the female body.

8. A buckle according to claim 7, wherein a belt placing member, which is capable of placing the belt thereon, is disposed on lower portions of front ends of said pair of supporting walls.

9. A buckle according to claim 7, wherein said housing is formed to be thicker at a side of said insertion opening and thinner at a side of the belt attaching portion; and a pair of guide projecting ridges for guiding said pair of supporting walls of said male body are provided on a rear surface of an upper face plate of said housing, extending from said insertion opening.

10. A buckle according to claim 1, wherein at least one guide ridge for guiding an insertion of the key is provided on an inner surface of said holding space, extending from said key insertion hole.

11. A buckle according to claim 1, wherein a small projection is protruded on an inner surface of said holding space; and a notch portion is provided at an end portion of said key so that said small projection is capable of being engaged with said notch portion.

12. A buckle according to claim 1, wherein at least one abutting portion, against which a front end of the key is capable of abutting, is protruded on one surface of said inserting portion.

13. A buckle according to claim 7, wherein a supporting member is disposed between side walls of said housing; a pressing portion is provided at a center of said supporting member; and said pressing portion is formed so as to press down said hitching member when said male body is inserted into said female body.

14. A buckle according to claim 4, wherein said key has a U-shaped front end; and said engaged portion is formed so as to be capable of being pressed down by inserting of said key between opposed faces of said housing and said inserting portion.

15. A buckle according to claim 5, wherein the key has a comb-shaped front end and is provided with a pressing-down portion for pressing down the engaged portion at a center of thereof, and said pressing-down portion is formed so as to be capable of being inserted in a cut-out portion formed at a center of said inserting portion.

16. A buckle according to claim 6, wherein said key is a flat plate and is adapted to be inserted in a hole defined on a pending portion provided on the front end of said engaged portion, and said engaged portion is formed so as to be pivotally movable.

17. A buckle according to claim 6, wherein said key has a two-forked shape, and a front end of said key is adapted to be inserted from said key insertion hole, which is formed at a side of the upper face plate of said housing, so that said engaged portion can be pressed down.

18. A buckle according to claim 1, wherein guide grooves which open from said insertion opening in an insertion direction of the male body are provided in said housing, and projecting portions for sliding in said guide grooves are provided at said belt adjusting portion.

* * * * *